US009656472B2

(12) United States Patent
Wang et al.

(10) Patent No.: US 9,656,472 B2
(45) Date of Patent: May 23, 2017

(54) LIQUID CARTRIDGE

(71) Applicant: BROTHER KOGYO KABUSHIKI KAISHA, Nagoya-shi, Aichi-ken (JP)

(72) Inventors: Yutao Wang, Obu (JP); Naoya Okazaki, Gifu-ken (JP); Tomohiro Kanbe, Nagoya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 14/838,438

(22) Filed: Aug. 28, 2015

(65) Prior Publication Data

US 2016/0279958 A1 Sep. 29, 2016

(30) Foreign Application Priority Data

Mar. 27, 2015 (JP) ..... 2015-066113

(51) Int. Cl.
*B41J 2/175* (2006.01)

(52) U.S. Cl.
CPC ..... *B41J 2/17526* (2013.01); *B41J 2/1752* (2013.01); *B41J 2/17513* (2013.01); *B41J 2/17553* (2013.01); *B41J 2/17566* (2013.01); *B41J 2002/17576* (2013.01)

(58) Field of Classification Search
CPC .. B41J 2/17513; B41J 2/1752; B41J 2/17523; B41J 2/17553; B41J 2/17503
See application file for complete search history.

(56) References Cited

U.S. PATENT DOCUMENTS 5,886,719 A 3/1999 Zepeda
5,949,459 A 9/1999 Gasvoda et al.
6,209,996 B1 4/2001 Gasvoda et al.
6,286,921 B1 9/2001 Ochi et al.
6,832,830 B2 12/2004 Seino et al.
7,350,909 B2 4/2008 Takagi et al.
8,272,704 B2 9/2012 Gilson et al.
(Continued)

FOREIGN PATENT DOCUMENTS

EP 2607082 A1 6/2013
GB 2477297 A 8/2011
(Continued)

OTHER PUBLICATIONS

U.S. Office Action issued in related U.S. Appl. No. 14/838,640, mailed Feb. 5, 2016.
(Continued)

*Primary Examiner* — Julian Huffman
*Assistant Examiner* — Sharon A Polk
(74) *Attorney, Agent, or Firm* — Merchant & Gould P.C.

(57) ABSTRACT

A liquid cartridge is configured to be inserted into a liquid consuming apparatus in a first direction along a horizontal direction against an urging force directed in a second direction opposite the first direction, and thereby to be mounted to the liquid consuming apparatus. The liquid cartridge is configured to pivot about a pivot center in the liquid consuming apparatus. The liquid cartridge includes a rear face, and the rear face includes a first portion and a second portion positioned further in an upward direction than the first portion. The first portion includes a portion positioned further in a downward direction than the pivot center, and the first portion is positioned further in the first direction than the second portion.

13 Claims, 15 Drawing Sheets

(56) References Cited

U.S. PATENT DOCUMENTS

| | | | |
|---|---|---|---|
| 8,439,488 | B2 | 5/2013 | Nakamura et al. |
| 8,529,036 | B2 | 9/2013 | Kodama et al. |
| 8,562,116 | B2 | 10/2013 | Kanbe et al. |
| 8,585,193 | B2 | 11/2013 | Kanbe et al. |
| 8,596,771 | B2 | 12/2013 | Takagi et al. |
| 8,596,772 | B2 | 12/2013 | Kanbe et al. |
| 8,651,639 | B2 | 2/2014 | Kanbe et al. |
| 8,678,573 | B2 | 3/2014 | Nakamura et al. |
| 8,931,888 | B2 | 1/2015 | Kanbe et al. |
| 8,950,839 | B2 | 2/2015 | Nozawa |
| 9,205,661 | B2 | 12/2015 | Kawate |
| 2002/0039124 | A1 | 4/2002 | Nanjo et al. |
| 2003/0222940 | A1 | 12/2003 | Seino et al. |
| 2007/0149044 | A1 | 6/2007 | Asauchi |
| 2008/0204527 | A1 | 8/2008 | Yuen |
| 2009/0135237 | A1 | 5/2009 | Nakamura et al. |
| 2009/0179925 | A1 | 7/2009 | Sugahara |
| 2011/0001781 | A1 | 1/2011 | Ishibe |
| 2011/0234658 | A1 | 9/2011 | Nozawa |
| 2011/0234716 | A1 | 9/2011 | Kubo et al. |
| 2011/0310197 | A1 | 12/2011 | Yazawa |
| 2012/0249691 | A1 | 10/2012 | Takagi et al. |
| 2013/0050357 | A1 | 2/2013 | Kanbe et al. |
| 2013/0050358 | A1 | 2/2013 | Kanbe et al. |
| 2013/0050359 | A1 | 2/2013 | Kanbe et al. |
| 2013/0050360 | A1 | 2/2013 | Kanbe et al. |
| 2013/0162733 | A1 | 6/2013 | Nakamura et al. |
| 2013/0278684 | A1 | 10/2013 | Kanbe et al. |
| 2014/0015904 | A1 | 1/2014 | Kanbe et al. |
| 2014/0055535 | A1 | 2/2014 | Takagi et al. |
| 2014/0247296 | A1 | 9/2014 | Nose |
| 2016/0279952 | A1 | 9/2016 | Wang |
| 2016/0279955 | A1 | 9/2016 | Wang et al. |
| 2016/0279959 | A1 | 9/2016 | Okazaki et al. |
| 2016/0279960 | A1 | 9/2016 | Okazaki et al. |

FOREIGN PATENT DOCUMENTS

| | | | |
|---|---|---|---|
| JP | 2000-309107 | A | 11/2000 |
| JP | 2002-508720 | A | 3/2002 |
| JP | 2005-131849 | A | 5/2005 |
| JP | 2005-246781 | A | 9/2005 |
| JP | 2005-313447 | A | 11/2005 |
| JP | 2007-144827 | A | 6/2007 |
| JP | 2008-93862 | A | 4/2008 |
| JP | 2008-194885 | A | 8/2008 |
| JP | 2010-23458 | A | 2/2010 |
| JP | 2012-206409 | A | 10/2012 |
| JP | 2012-206487 | A | 10/2012 |
| JP | 2013-49165 | A | 3/2013 |
| JP | 2014-19130 | A | 2/2014 |
| WO | 2007-003908 | A1 | 1/2007 |
| WO | 2012-054050 | A1 | 4/2012 |
| WO | 2015-041365 | A1 | 3/2015 |

OTHER PUBLICATIONS

International Search Report and Written Opinion issued in related PCT/JP2015/003434, Oct. 6, 2015.
European Search Report issued in European Patent Application No. 15174866.2, mailed Feb. 16, 2016.
European Search Report issued in European Patent Application No. 15174873.8, mailed Feb. 16, 2016.
International Search Report and Written Opinion issued in related PCT/JP2015/003414, Oct. 6, 2015.
Office Action issued in related U.S. Appl. No. 14/828,597, Apr. 22, 2016.
Office Action issued in related U.S. Appl. No. 14/838,453, May 19, 2016.
International Search Report and Written Opinion issued in PCT Application No. PCT/JP2015/003417, mailed Sep. 29, 2015.
International Search Report and Written Opinion against PCT Application no. PCT/JP2015/003423, mailed Sep. 29, 2015.
International Search Report and Written Opinion against PCT Application no. PCT/JP2015/003416, mailed Sep. 29, 2015.
International Search Report and Written Opinion against PCT Application no. PCT/JP2015/003419, mailed Sep. 29, 2015.
U.S. Appl. No. 14/838,440, filed Aug. 28, 2015.
U.S. Appl. No. 14/838,453, filed Aug. 28, 2015.
U.S. Appl. No. 14/838,597, filed Aug. 28, 2015.
U.S. Appl. No. 14/838,640, filed Aug. 28, 2015.
Search Report from European Patent Application No. 15174868.8, mailed Feb. 12, 2016.
Search Report from European Patent Application No. 15174888.6, mailed Feb. 12, 2016.
Search Report from European Patent Application No. 15174893.6, mailed Feb. 12, 2016.
Office Action (Notice of Allowance), issued in related U.S. Appl. No. 14/838,640, Sep. 9, 2016.
Final Office Action, issued in related U.S. Appl. No. 14/838,597, Nov. 22, 2016.
Final Office Action, issued in related U.S. Appl. No. 14/838,453, Nov. 21, 2016.
"Office Action issued in related U.S. Appl. No. 14/838,440, Jul. 29, 2016."

LIQUID CARTRIDGE

CROSS REFERENCE TO RELATED APPLICATION

The present invention claims priority to and the benefit of Japanese Patent Application No. 2015-066113, which was filed on Mar. 27, 2015, the disclosure of which is incorporated herein by reference in its entirety.

BACKGROUND OF THE INVENTION

1. Field of the Invention

The present invention relates to a liquid cartridge.

2. Description of Related Art

A known ink-jet recording apparatus is configured to record an image on a medium by ejecting ink stored in an ink cartridge from nozzles onto the medium. When ink is used up, the ink cartridge is replaced.

A known apparatus, as described in U.S. Pat. No. 5,949,459, has a container receiving station configured to receive an ink container, and the container receiving station has latching features. The ink container has corresponding latching features. When the ink container is inserted into the container receiving station, the latching features of the ink container engage the corresponding latching features of the container receiving portion, and thereby the ink container is locked in the container receiving station against urging forces of springs.

In the known apparatus, the ink container needs to pivot from an attitude in which the latching features of the ink container do not engage the corresponding latching features of the container receiving portion to an attitude in which the latching features of the ink container engage the corresponding features of the container receiving portion, so that the ink container is locked against the urging forces of springs. Therefore, a user needs to intentionally apply a force to the rear face of the ink container in a direction (horizontal direction) opposite the direction in which the springs urge the ink container, and in a direction (downward direction) intersecting the direction in which the springs urge the ink container, so that the ink container can pivot and the latching features can engage the corresponding latching features.

Because the springs urge a lower portion of the front face of the ink container, if a user pushes an upper portion (pointed by an arrow in U.S. Pat. No. 5,949,459) of the rear face of the ink container, the ink container pivots upward about a point where the springs urge the ink container. Therefore a user needs to intentionally have the ink container pivot downward after pushing the ink container in the horizontal direction.

SUMMARY OF THE INVENTION

Therefore, a need has arisen for a liquid cartridge which overcomes these and other shortcomings of the related art. A technical advantage of the present invention is that a liquid cartridge may readily be locked in a liquid consuming apparatus.

According to an aspect of the present invention, a liquid cartridge is configured to be inserted into a liquid consuming apparatus in a first direction along a horizontal direction against an urging force directed in a second direction opposite the first direction, and thereby to be mounted to the liquid consuming apparatus. The liquid cartridge comprises: a liquid chamber configured to store liquid therein; a front face facing the first direction when the liquid cartridge is inserted into the liquid consuming apparatus; a liquid supply portion positioned at the front face and configured to allow insertion of a liquid supply tube of the liquid consuming apparatus thereinto; a seal member positioned at the liquid supply portion and having a liquid supply opening formed therethrough, wherein the seal member is configured to contact an outer surface of the liquid supply tube while being elastically deformed when the liquid supply tube is inserted through the liquid supply opening; an upper face facing an upward direction when the liquid cartridge is inserted into the liquid consuming apparatus; a lock surface positioned at the upper face and configured to contact a lock portion of the liquid consuming apparatus in the second direction; and a rear face facing the second direction when the liquid cartridge is inserted into the liquid consuming apparatus, wherein the liquid cartridge is configured to pivot about a pivot center which is a center of the liquid supply opening, when the liquid cartridge is inserted into the liquid consuming apparatus and the liquid supply tube is inserted through the liquid supply opening, wherein the liquid cartridge is configured to pivot between a first attitude and a second attitude, wherein when the liquid cartridge is in the first attitude, the lock surface contacts the lock portion in the second direction and movement of the liquid cartridge relative to the liquid consuming apparatus in the second direction is restricted, and wherein when the liquid cartridge is in the second attitude, the lock surface is positioned further in a downward direction than the lock portion, and the rear face comprises a first portion and a second portion positioned further in the upward direction than the first portion, wherein the first portion comprises a portion positioned further in the downward direction than the pivot center, and the first portion is positioned further in the first direction than the second portion.

With this configuration, because the first portion is positioned further in the first direction than the second portion when the liquid cartridge is inserted into the liquid consuming apparatus, a user tends to push the second portion, which is positioned closer to the user, and tends not to push the first portion. When the second portion is pushed, a moment of force is applied to the liquid cartridge in the liquid consuming apparatus, such that the liquid cartridge pivots about the pivot center from the second attitude to the first attitude. The lock surface of the liquid cartridge in the first attitude contacts the lock portion in the second direction, and the movement of the liquid cartridge relative to the liquid consuming apparatus in the second direction is restricted, i.e., the liquid cartridge is locked in the liquid consuming apparatus. A user can readily insert and lock the liquid cartridge in the liquid consuming apparatus.

Optionally, the second portion comprises a letter or symbol thereon, and the letter or symbol indicates that the second portion is supposed to be pushed.

With this configuration, a user is urged to push the second portion.

Optionally, the following condition is satisfied: $FH>GL$. G is a magnitude of a gravitational force acting on the liquid cartridge, F is a magnitude of the urging force urging the liquid cartridge in the second direction when the liquid cartridge is in the first attitude, L is a distance between the center of gravity of the liquid cartridge and the pivot center along the first direction when the liquid cartridge is in the second attitude, and H is a height of a lower end of the second portion from the pivot center along the upward direction perpendicular to the first direction when the liquid cartridge is in the second attitude.

With this configuration, a moment of force generated by the second portion being pushed and causing the liquid cartridge to pivot from the second attitude to the first attitude becomes greater than a moment of force generated by the gravitational force acting on the liquid cartridge and causing the liquid cartridge to pivot from the first attitude to the second attitude.

Optionally, the first portion is a plane intersecting a first virtual plane at an angle of a degrees when the liquid cartridge is in the second attitude, and the first virtual plane is perpendicular to the first direction. The following condition is satisfied: $(F \cos \alpha)N>GL$. N is a length of a perpendicular line extending from the pivot center to a second virtual plane which is perpendicular to the first portion and intersects a lower end of the first portion.

With this configuration, even if the first portion is pushed, a moment of force generated by the first portion being pushed and causing the liquid cartridge to pivot from the second attitude to the first attitude becomes greater than the moment of force generated by the gravitational force acting on the liquid cartage and causing the liquid cartridge to pivot from the first attitude to the second attitude.

Optionally, the liquid cartridge further comprises a receive portion configured to receive the urging force directed in the second direction, wherein the receive portion is positioned further in the downward direction than the liquid supply portion when the liquid cartridge is in the second attitude.

With this configuration, an additional moment of force is applied to the liquid cartridge, causing the liquid cartridge to pivot from the second attitude to the first attitude.

Optionally, the receive portion is configured to receive the urging force from an urging member provided in the liquid consuming apparatus.

Optionally, the liquid cartridge further comprises an electrical interface positioned at the upper face and configured to contact a contact provided in the liquid consuming apparatus when the liquid cartridge is in both the first attitude and the second attitude in the liquid consuming apparatus, wherein when the liquid cartridge is in the second attitude, a position of the pivot center along the first direction and a position of the electrical interface along the first direction at least partly overlap.

With this configuration, the magnitude of a moment of force generated by an urging force of the contact and applied to the liquid cartridge is zero or very small.

Optionally, the liquid cartridge further comprises an operation surface positioned at the upper face and positioned further in the second direction than the lock surface.

With this configuration, because the operation surface is positioned more remote from the pivot center than the lock surface is, when a user intends to release the liquid cartridge from the first attitude, the user can readily operate the operation surface to cause the liquid cartridge to pivot from the first attitude to the second attitude.

The operation surface faces the upward direction and the second direction.

With this configuration, when a user operates the operation surface to release the liquid cartridge from the first attitude, the user's force is directed toward the downward direction and the first direction. Due to the force directed toward the first direction, the lock surface separates from the lock portion. Due to the force directed toward the downward direction, the liquid cartridge pivots from the first attitude to the second attitude. Therefore, compared to a situation in which the liquid cartridge pivots from the first attitude to the second attitude while the lock surface slides on the lock portion, the force needed to be applied to the operation surface to cause the liquid cartridge to pivot from the first attitude to the second attitude becomes smaller, and the user can readily release the liquid cartridge.

Optionally, the operation surface does not move relative to the liquid chamber.

With this configuration, a force applied to the operation surface is directly transmitted to the liquid cartridge without changing its direction.

Optionally, the upper face comprises a sub upper face positioned further in the third direction than the operation surface, the operation surface and the sub upper face at least partly overlap in the third direction, and a space is formed between the operation surface and the sub upper face in the third direction.

With this configuration, the operation surface becomes recognizable to a user.

Optionally, the operation surface comprises a plurality of elongated protrusions.

With this configuration, the operation surface becomes recognizable to a user, and the operation surface becomes nonskid when the user operates the operation surface with his/her finger.

Optionally, when the liquid cartridge is in the first attitude, an upper end of the lock surface is positioned outside of a virtual circle and a lower end of the lock surface is positioned within the virtual circle, wherein the virtual circle has a center at the pivot center and intersects the lock portion.

With this configuration, when the urging force is applied to the liquid cartridge in the removal direction while the lock surface contacts the lock portion, the lock portion slides on the lock surface toward the lower end of the lock surface.

Optionally, the liquid cartridge is configured to be inserted into a case of the liquid consuming apparatus, and the lock surface is configured to contact the lock portion which does not move relative to the case.

With this configuration, the liquid cartridge pivots to be locked by the lock portion which does not move relative to the case.

Optionally, a liquid consuming apparatus comprises; the afore-mentioned liquid cartridge; and a cartridge mounting portion, wherein the liquid cartridge is configured to be inserted into the cartridge mounting portion in the first direction against the urging force directed in the second direction, and thereby to be mounted to the cartridge mounting portion, and the cartridge mounting portion comprises: the liquid supply tube configured to be inserted into the liquid supply portion; and the lock portion configured to contact the lock surface.

According to another aspect of the invention, a liquid cartridge comprises: a liquid chamber configured to store liquid therein; a front face; a rear face, wherein the liquid chamber is positioned between the front face and the rear face, and the rear face comprises an upper portion and a lower portion; an upper face; an lower face, wherein the liquid chamber is positioned between the upper face and the lower face; a liquid supply portion positioned at the front face; a seal member positioned at the liquid supply portion and having elasticity, wherein the seal member has a liquid supply opening formed therethrough, and the liquid supply opening has a central axis; a lock surface positioned at the upper face; and an operation surface positioned at the upper face, wherein a distance from the lock surface to the front face in a first direction is greater than a distance from the lock surface to the rear face in a second direction, the distance from the lock surface to the front face in the first direction is less than a distance from the operation surface to the front face in the first direction, a distance from the upper portion to the lower face in a third direction is greater than a distance from the lower portion to the lower face in the third direction, a distance from the upper portion to the front face in the first direction is greater than a distance from the lower portion to the front face in the first direction, the lower portion comprises a portion positioned between the central axis of the liquid supply opening and the lower face in the third direction, the first direction extends from the rear face toward the front face, the second direction is opposite to the first direction and extends from the front face toward the rear face, and the third direction is perpendicular to the first direction and the second direction and extends from the upper face toward the lower face.

With this configuration, the liquid cartridge can readily be locked in the liquid consuming apparatus, and also can readily be released.

Optionally, the lower portion is closer to the front face at a position closer to the lower face, or the lower portion becomes closer to the front face as it approaches to the lower face.

With this configuration, even if the lower portion is pushed, a moment of force generated by the lower portion being pushed and causing the liquid cartridge to pivot from the second attitude to the first attitude becomes greater than a moment of force generated by the gravitational force acting on the liquid cartage and causing the liquid cartridge to pivot from the first attitude to the second attitude.

Optionally, the lower portion comprises a plane.

Optionally, the upper face comprises a sub upper face positioned further in the third direction than the operation surface, a position of the operation surface along the first direction and a position of the sub upper face along the first direction at least partly overlap, or the operation surface and the sub upper face at least partly overlap in the third direction, and a space is formed between the operation surface and the sub upper face in the third direction.

With this configuration, the operation surface becomes recognizable to a user.

Optionally, the operation surface is viewable when the liquid cartridge is viewed in the third direction, and the operation surface is viewable when the liquid cartridge is viewed in the first direction.

With this configuration, when a user operates the operation surface to release the liquid cartridge from the first attitude, the user's force is directed toward the first direction and the third direction. Due to the force directed toward the first direction, the lock surface separates from the lock portion. Due to the force directed toward the third direction, the liquid cartridge pivots from the first attitude to the second attitude. Therefore, compared to a situation in which the liquid cartridge pivots from the first attitude to the second attitude while the lock surface slides on the lock portion, the force needed to be applied to the operation surface to cause the liquid cartridge to pivot from the first attitude to the second attitude becomes smaller, and the user can readily release the liquid cartridge.

Optionally, at least a portion of the operation surface protrudes further than the lock surface in a fourth direction opposite to the third direction and extending from the lower face toward the upper face.

With this configuration, even when the liquid cartridge falls with the upper face facing downward, the lock surface may be protected by the at least a portion of the operation surface and may not be damaged.

Optionally, the operation surface comprises a plurality of protrusions formed thereon. Optionally, the plurality of protrusions is a plurality of elongated protrusions.

With this configuration, the operation surface becomes recognizable to a user, and the operation surface becomes nonskid when the user operates the operation surface with his/her finger.

Optionally, the operation surface does not move relative to the liquid chamber.

With this configuration, a force applied to the operation surface is directly transmitted to the liquid cartridge without changing its direction.

Other objects, features, and advantages will be apparent to persons of ordinary skill in the art from the following detailed description of the invention and the accompanying drawings.

BRIEF DESCRIPTION OF THE DRAWINGS

For a more complete understanding of the present invention, needs satisfied thereby, and the objects, features, and advantages thereof, reference now is made to the following description taken in connection with the accompanying drawings.

DETAILED DESCRIPTION OF EMBODIMENTS OF THE INVENTION

Figure 1:
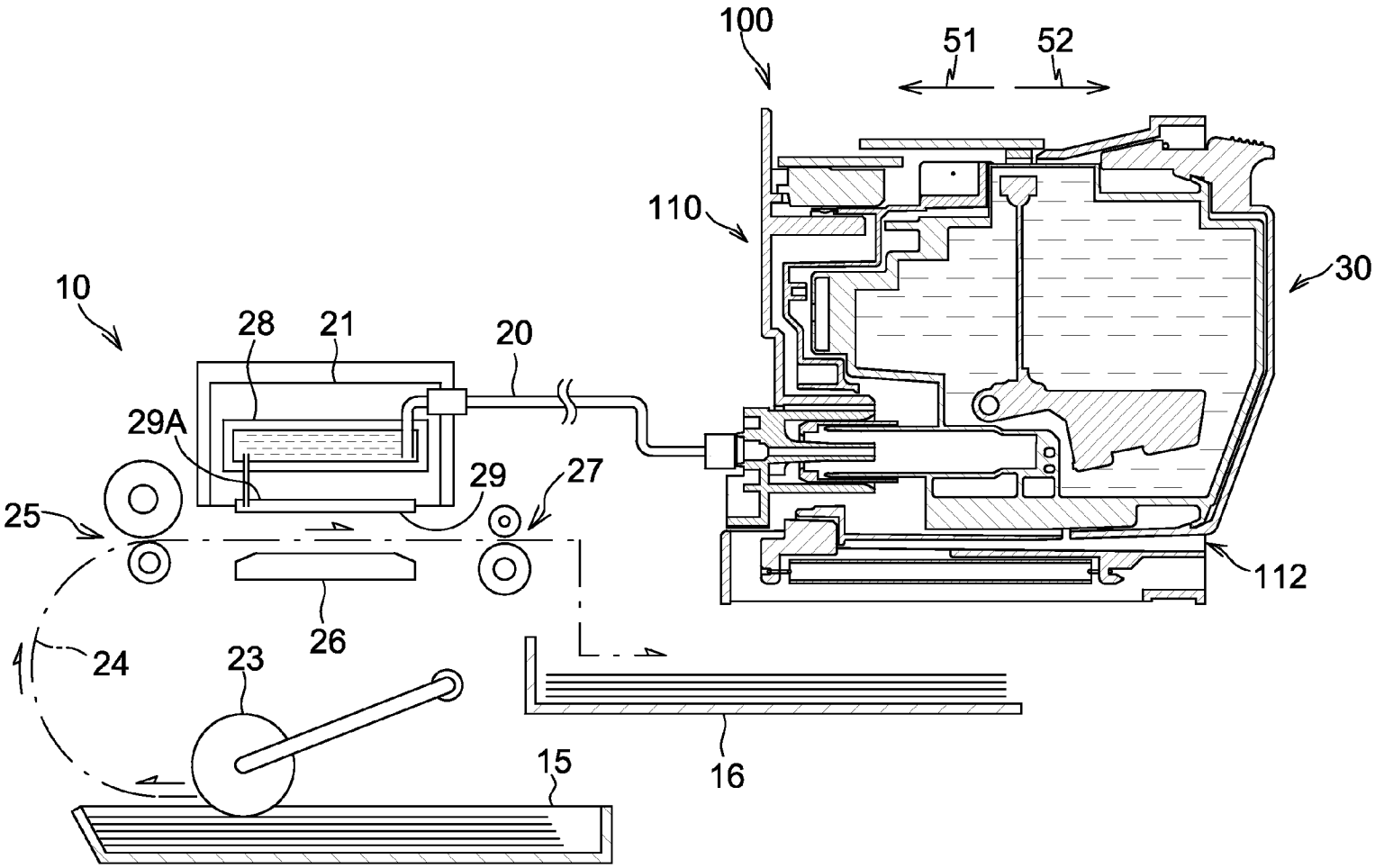
FIG. 1 is a schematic, cross-sectional view of a printer comprising a cartridge mounting portion and an ink cartridge, according to an embodiment of the present invention.

Embodiments of the present invention, and their features and advantages, may be understood by referring to FIGS. 1-15B, like numerals being used for like corresponding parts in the various drawings.

In the following embodiments, an ink cartridge 30 is inserted into a cartridge mounting portion 110 in an insertion direction 51, as an example of a first direction, and the ink cartridge 30 is removed from the cartridge mounting portion 110 in a removal direction 52, as an example of a second direction, which is oppose to the insertion direction 51. In the following embodiments, the insertion direction 51 is a horizontal direction, and the removal direction 52 is also a horizontal direction. Nevertheless, in embodiments, the insertion direction 51 and the removal direction 52 may not be a horizontal direction. In the following embodiments, a downward direction 53 is the gravitational direction, and an upward direction 54 is a direction opposite to the gravitational direction. Moreover, a right direction 55 is perpendicular to the insertion direction 51 and the downward direction 53, and a left direction 56 is opposite to the right direction 55 and perpendicular to the insertion direction 51 and the downward direction 53. More specifically, the right direction 55 extends rightward and the left direction 56 extends leftward when the ink cartridge 30 is viewed in the removal direction 52 when the ink cartridge 30 is in a mounted attitude, as an example of a first attitude. The mounted attitude is an attitude that the ink cartridge 30 takes when the ink cartridge 30 has been inserted into the cartridge mounting portion 110 up to a mounted position and is locked in the cartridge mounting portion 110. Furthermore, the insertion direction 51 is also called a forward direction 57, and the removal direction 52 is also called a rearward direction 58.

[Printer 10]

Referring to FIG. 1, a liquid consuming apparatus, e.g., a printer 10 is an inkjet printer configured to record an image on a sheet of recording paper by ejecting ink droplets selectively on the sheet of recording paper. The printer 10 comprises a liquid consuming portion, e.g., a recording head 21, an ink supply device 100, and an ink tube 20 connecting the recording head 21 and the ink supply device 100. The ink supply device 100 comprises the cartridge mounting portion 110. The cartridge mounting portion 110 is configured to allow a liquid cartridge, e.g., the ink cartridge 30 to be mounted therein. The cartridge mounting portion 110 has an opening 112 and the interior of the cartridge mounting portion 110 is exposed to the exterior of the cartridge mounting portion 110 via opening 112. The ink cartridge 30 is configured to be inserted into the cartridge mounting portion 110 via the opening 112 in the insertion direction 51, and to be removed from the cartridge mounting portion 110 via the opening 112 in the removal direction 52.

The ink cartridge 30 is configured to store ink, as an example of liquid, which is used by the printer 10. The ink cartridge 30 and the recording head 21 are fluidically connected via the ink tube 20 when mounting of the ink cartridge 30 to the cartridge mounting portion 110 has been completed. The recording head 21 comprises a sub tank 28. The sub tank 28 is configured to temporarily store ink supplied via the ink tube 20 from the ink cartridge 30. The recording head 21 comprises nozzles 29 and is configured to selectively eject ink supplied from the sub tank 28 through the nozzles 29. More specifically, the recording head 21 comprises a head control board (not shown) and piezoelectric actuators 29A corresponding to the nozzles 29, and the head control board is configured to selectively apply driving voltage to the piezoelectric actuators 29A. As such, ink is ejected from the nozzles 29.

The printer 10 comprises a paper feed tray 15, a paper feed roller 23, a conveying roller pair 25, a platen 26, a discharge roller pair 27, and a discharge tray 16. A conveying path 24 is formed from the paper feed tray 15 up to the discharge tray 16 via the conveying roller pair 25, the platen 26, and the discharge roller pair 27. The paper feed roller 23 is configured to feed a sheet of recording paper from the paper feed tray 15 to the conveying path 24. The conveying roller pair 25 is configured to convey the sheet of recording paper fed from the paper feed tray 15 onto the platen 26. The recording head 21 is configured to selectively eject ink onto the sheet of recording paper passing over the platen 26. Accordingly, an image is recorded on the sheet of recording paper. The sheet of recording paper having passed over the platen 26 is discharged by the discharge roller pair 27 to the paper discharge tray 16 disposed at the most downstream side of the conveying path 24.

[Ink Supply Device 100]

Referring to FIG. 1, the printer 10 comprises the ink supply device 100. The ink supply device 100 is configured to supply ink to the recording head 21. The ink supply device 100 comprises the cartridge mounting portion 110 to which the ink cartridge 30 is mountable. In FIG. 1, mounting of the ink cartridge 30 to the cartridge mounting portion 110 has been completed, in other words, the ink cartridge 30 is in the mounted attitude (first attitude).

[Cartridge Mounting Portion 110]

Figure 2:
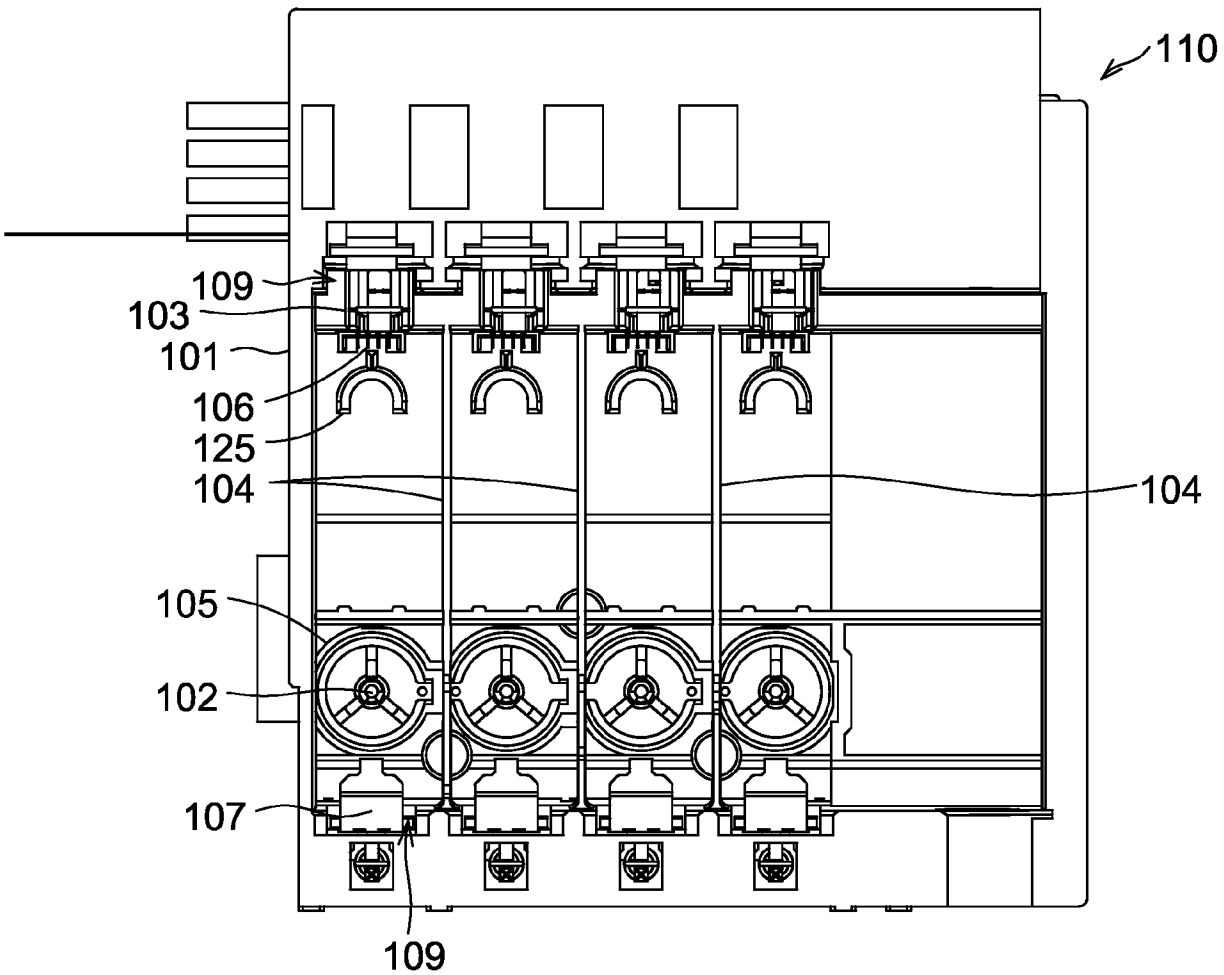
FIG. 2 is a front view of the cartridge mounting portion.
Figure 7:
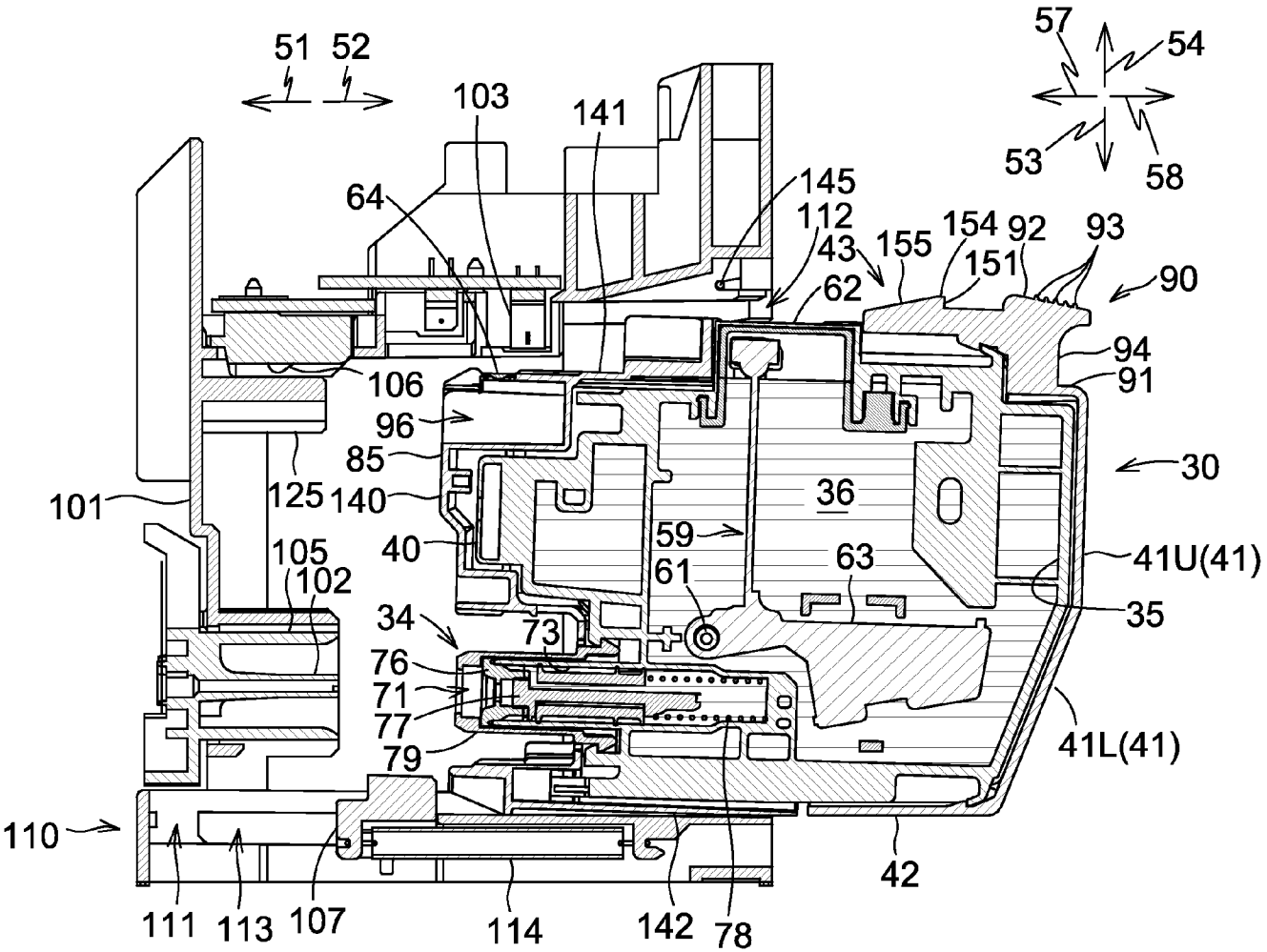
FIG. 7 is a vertical cross-sectional view of the ink cartridge and the cartridge mounting portion, in which the ink cartridge has started to be inserted into the cartridge mounting portion.

Referring to FIGS. 2 and 7, the cartridge mounting portion 110 is configured to receive four ink cartridges 30 storing cyan, magenta, yellow, and black inks, respectively. The cartridge mounting portion 110 comprises a case 101, and four ink supply tubes 102, four sensors 103, four sets of four contacts 106, four sliders 107, and four rods 125, corresponding to the four ink cartridges 30, respectively. The cartridge mounting portion 110 also comprises a lock portion 145. One common lock portion 145 is used for the four ink cartridges 30. The number of the ink cartridges 30 is not limited to four. For instance, in another embodiment, the cartridge mounting portion 110 may be configured to receive only one ink cartridge 30, six ink cartridges 30, or eight ink cartridges 30.

[Case 101]

The case 101 has a box shape and forms the outer shape of the cartridge mounting portion 110. The case 101 has an inner space formed therein. The case 101 comprises an upper portion defining the upper end of the inner space, a lower portion defining the lower end of the inner space, and an end surface connected to the upper portion and the lower portion. The case 101 has the opening 112 formed opposite from the end surface in the insertion direction 51 and the removal direction 52. The opening 112 can be exposed to the outside of the printer 10 through a user-interface surface of the printer 10. The user-interface surface is a surface that a user faces and touches when the user uses the printer 10. The ink cartridge 30 is configured to be inserted into and removed from the case 101 through the opening 112. Each of the upper portion and the lower portion of the case 101 has a guide groove 109 formed therein, and the guide groove 109 extends in the insertion direction 51 from the opening 112. When the ink cartridge 30 is inserted into and removed from the case 101, an upper end portion of the ink cartridge 30 is in the guide groove 109 of the upper portion of the case 101, and a lower end portion of the ink cartridge 30 is in the guide groove 109 of the lower portion of the case 101, such that the movement of the ink cartridge 30 is guided in the insertion direction 51 and the removal direction 52. The case 101 comprises three plates 104 extending in the upward direction 54 and the downward direction 53, and the three plates 104 divide the inner space of the case 101 into four vertically-elongated spaces. Each of the four spaces receives the corresponding one of the ink cartridges 30.

[Ink Supply Tube 102]

Referring to FIGS. 1, 2 and 7, the ink supply tube 102 is made of synthetic resin and positioned at a lower portion of the end surface of the case 101 at a position corresponding to an ink supply portion 34 of the ink cartridge 30 mounted to the cartridge mounting portion 110. The ink supply tube 102 extends from the end surface of the case 101 in the removal direction 52.

A cylindrical guide portion 105 is provided to surround the ink supply tube 102. The guide portion 105 extends from the end surface of the case 101 in the removal direction 52, and has an inner space which is open at the distal end of the guide portion 105. The ink supply tube 102 is positioned at the center of the inner space of the guide portion 105. The guide portion 105 has such a shape that it can receive the ink supply portion 34 of the ink cartridge 30 in the inner space of the guide portion 105.

Figure 10:
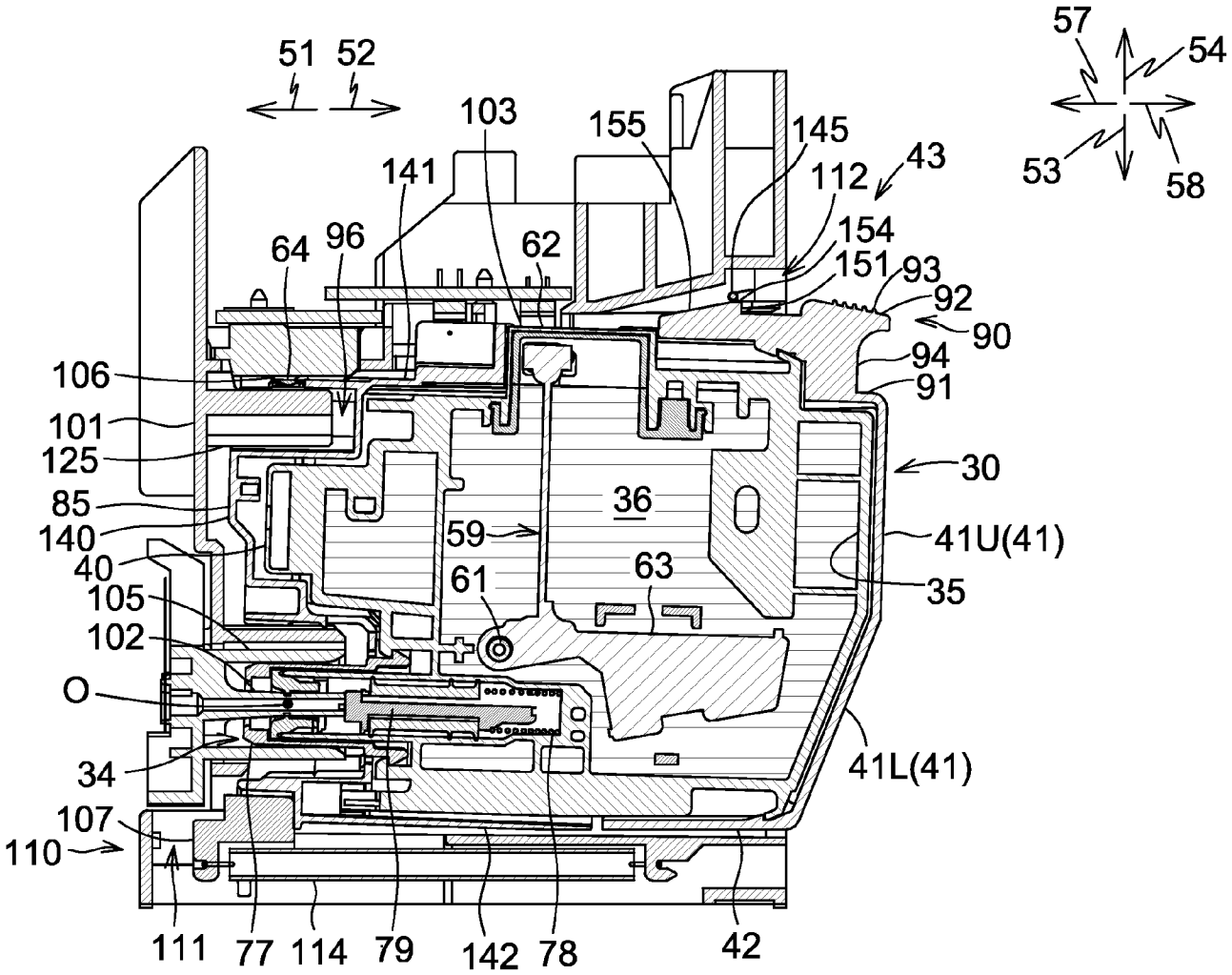
FIG. 10 is a vertical cross-sectional view of the ink cartridge and the cartridge mounting portion, in which an ink supply tube is inserted through an ink supply opening of the ink supply portion.

Referring to FIG. 10, during the insertion of the ink cartridge 30 into the cartridge mounting portion 110 in the insertion direction 51, i.e., while the ink cartridge 30 moves toward the mounted position, the ink supply portion 34 of the ink cartridge 30 enters the inner space of the guide portion 105. When the ink cartridge is further inserted into the cartridge mounting portion 110 in the insertion direction 51, the ink supply tube 102 is inserted through an ink supply opening 71 formed in the ink supply portion 34. When this occurs, a valve 77 provided in the ink supply portion 34 moves to open the ink supply opening 71. As a result, the ink supply tube 102 and the ink supply portion 34 are connected to each other. Ink stored in an ink chamber 36 of the ink cartridge 30 flows into ink tube 20 connected to the ink supply tube 102 via an inner space of a cylindrical wall 73 of the ink supply portion 34 and an inner space of the ink supply tube 102. The ink supply tube 102 may have a flat end surface or pointed end.

[Slider 107]

Referring to FIGS. 7 to 11, the lower portion of the case 101 comprises a groove bottom wall defining the bottom end of the guide groove 109. The groove bottom wall has an opening 111 formed therethrough in the upward direction 54 and the downward direction 53 at a positon adjacent to the end surface of the case 101, and the opening 111 extends in the insertion direction 51 and the removal direction 52. The slider 107 is positioned in the opening 111. The slider 107 extends from a space below the groove bottom wall to a space above the groove bottom wall through the opening 111. The case 101 comprises a guide rail 113 extending in the insertion direction 51 and the removal direction 52, and the slider 107 is configured to slide on the guide rail 113 in the insertion direction 51 and the removal direction 52 in the opening 111. A pulling spring 114 is connected to the case 101 at one end and to the slider 107 at the other end. The pulling spring 114 pulls the slider 107 in the removal direction 52. Therefore, when an external force is not applied to the slider 107, the slider 107 is positioned at the end of the guide rail 113 in the removal direction 52. When an external force is applied to the slider 107 in the insertion direction 51, the slider 107 moves from the end of the guide rail 113 in the insertion direction 51 along the guide rail 113 in the opening 111.

Figure 8:
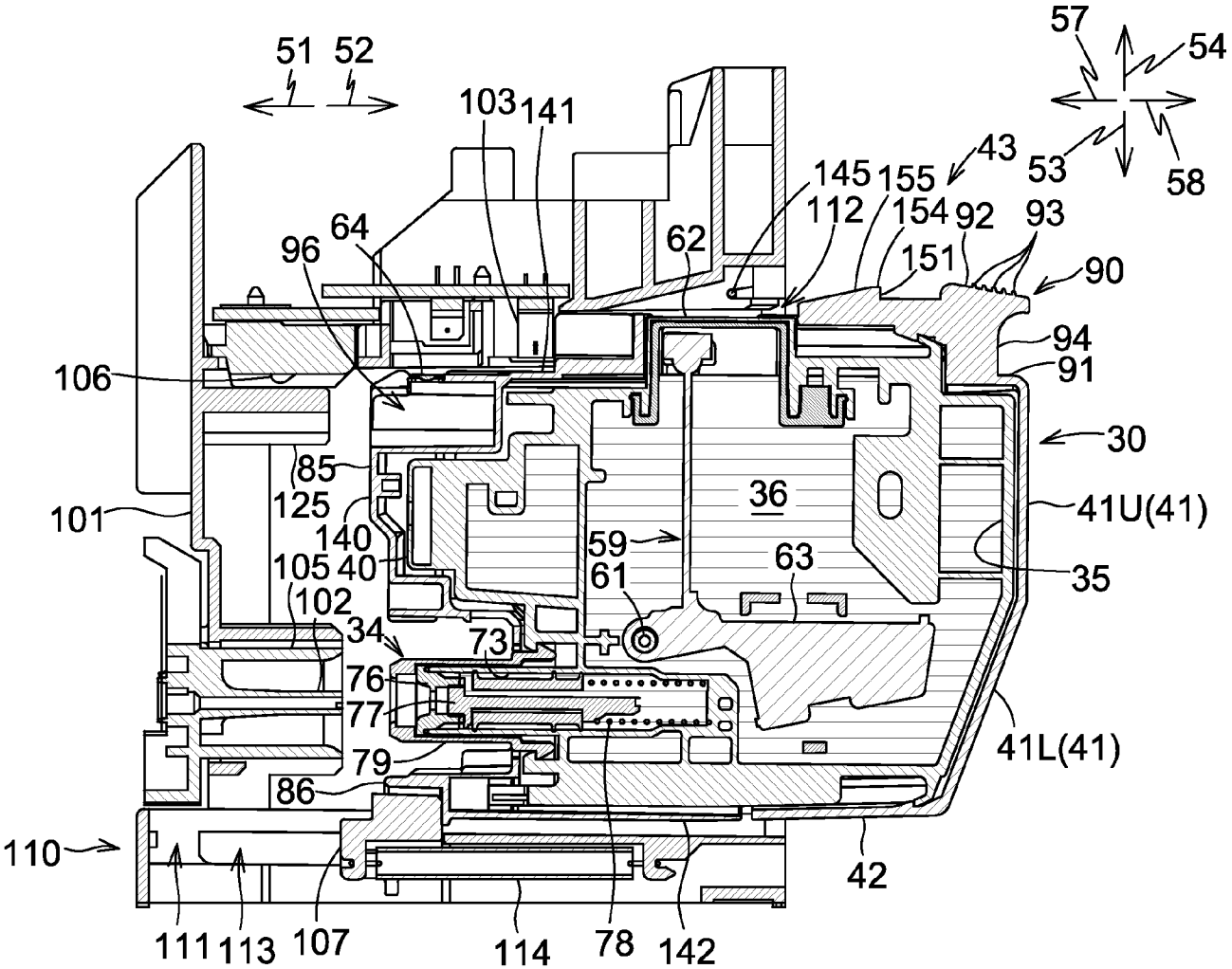
FIG. 8 is a vertical cross-sectional view of the ink cartridge and the cartridge mounting portion, in which a second protrusion contacts a slider.

Referring to FIG. 8, during the insertion of the ink cartridge 30 into the cartridge mounting portion 110 in the insertion direction 51, i.e., while the ink cartridge 30 moves toward the mounted position, a second protrusion 86 of the ink cartridge 30 moves in the guide groove 109 in the insertion direction 51 and contact the slider 107. When the ink cartridge 30 is further inserted into the cartridge mounting portion 110 in the insertion direction 51, the second protrusion 86 pushes the slider 107 in the insertion direction 51, and the slider 107 moves in the insertion direction 51 against an urging force of the pulling spring 114. The second protrusion 86 of the ink cartridge 30 receives the urging force in the second direction 52 from the slider 107. The slider 107 and the pulling spring 114 are an example of an urging member.

[Lock Portion 145]

Referring to FIGS. 2 and 7, the lock portion 145 is positioned adjacent to the upper portion of the case 101 and the opening 112. The lock portion 145 has an elongated shape extends in the left direction 56 and the right direction 55 in the case 101. For instance, the lock portion 145 is a metal circular cylinder. The lock portion 145 has a left end in the left direction 56 and a right end in the right direction 55, and the case 101 has a left end wall defining the end of the inner space of the case 101 in the left direction 56 and a right end wall defining the end of the inner space of the case 101 in the right direction 55. The left end of the lock portion 145 is fixed at the left end wall of the case 101, and the right end of the lock portion 145 is fixed at the right end wall of the case 101. The lock portion 145 is fixed relative to, but not necessarily directly to, the case 101 and thus does not move relative to the case 101, e.g., does not pivot relative to the case 101. The lock portion 145 extends over the four spaces into which the four cartridges 30 are mountable, respectively. A space is formed around the lock portion 145 in each of the four spaces. Therefore, the lock portion 145 is accessible in the upward direction 54 and in the removal direction 52.

The lock portion 145 is used for locking the ink cartridge 30 in the mounted position when the ink cartridge 30 is mounted to the cartridge mounting portion 110. When the ink cartridge 30 is inserted into the cartridge mounting portion 110 and pivots to the mounted attitude as an example of the first attitude, the ink cartridge 30 contacts the lock portion 145 in the removal direction 52, and the lock portion 145 locks or retains the ink cartridge 30 against the urging force from the slider 107, which urging force urges the ink cartridge 30 in the removal direction 52, and against an urging force of a coil spring 78 of the ink cartridge 30, which urging force also urges the ink cartridge 30 in the removal direction 52.

[Contacts 106]

Referring to FIGS. 2 and 7, the four contacts 106 are positioned adjacent to the upper portion of the case 101 and the end surface of the case 101. Although not shown in the drawings, the four contacts 106 are aligned with and spaced apart from each other in the left direction 56 and the right direction 55. The arrangement of the four contacts 106 corresponds to the arrangement of four electrodes 65 of the ink cartridge 30. Each contact 106 is made of a material having electric conductivity and elasticity and can be elastically deformed in the upward direction 54. The four sets of four contacts 106 are provided, corresponding to the four ink cartridges 30, respectively. The number of contacts 106 in one set is not limited to four, but may be two, three or more than four, and the number of electrodes 65 of one ink cartridge 30 is not limited to four, but may be two, three or more than four.

Each contact 106 is electrically connected to an arithmetic unit (not shown) of the printer 10 via an electric circuit. The arithmetic unit may comprise a CPU, a ROM, and a RAM, and may be used as a controller for controlling the operations of the printer 10. When the contacts 106 and the corresponding electrodes 65 contact, voltage may be applied to one of the electrodes 65 from the printer 10, or one of the electrode 65 may be grounded. When the contacts 106 and the corresponding electrodes 65 contact, data stored in an IC of the ink cartridge 30 becomes accessible from the printer 10, and the data can be transmitted to the arithmetic unit via the electric circuit of the printer 10.

[Rod 125]

Referring to FIGS. 2 and 7, the rod 125 is positioned at the end surface of the case 101 above the ink supply tube 102. The rod 125 extends from the end surface in the removal direction 52. The rod 125 has a cross-sectional shape taken along a plane perpendicular to the removal direction 52, and the cross-sectional shape of the rod 125 is substantially an inversed U-shape, like an upper half of a circle. The rod 125 has a rib extending from the uppermost part of the U-shaped portion, and the rib extends in the removal direction 52. The rod 125 is inserted into a recess 96 formed in the ink cartridge 30 when the ink cartridge 30 is mounted to the cartridge mounting portion 110, i.e., when the ink cartridge 30 is in the mounted position.

[Sensor 103]

Referring to FIGS. 2 and 7, the sensor 103 is positioned at the upper portion of the case 101. The sensor 103 comprises a light emitting portion and a light receiving portion. The light receiving portion is spaced apart from the light emitting portion in the right direction 55 or the left direction 56. The light emitting portion and the light receiving portion faces each other in the right direction 55 and the left direction 56. When the mounting of the ink cartridge 30 to the cartridge mounting portion 110 is completed, a detection portion 62 of the ink cartridge 30 is positioned between the light emitting portion and the light receiving portion.

The light emitting portion of the sensor 103 is configured to emit light, e.g., visible or infrared light. The sensor 103 is configured to output different signals based on whether or not the light receiving portion receives the light emitted from the light emitting portion. If the light receiving portion does not receive the light emitted from the light emitting portion, i.e., if the intensity of light received by the light receiving portion is less than a threshold value, the sensor 103 outputs a Low-level signal, i.e., a signal whose level is less than a threshold level. On the other hand, if the light receiving portion receives the light emitted from the light emitting portion, i.e., the intensity of light received by the light receiving portion is greater than or equal to the threshold value, the sensor outputs a High-level signal, i.e., a signal whose level is greater than or equal to the threshold level.

[Ink Cartridge 30]

Referring to FIGS. 3 to 6, the ink cartridge 30 is a container configured to store ink. The ink cartridge 30 has an inner space formed therein, and the inner space is the ink chamber 36, as an example of a liquid chamber, configured to store ink, as an example of liquid. The ink cartridge 30 comprises an inner frame 35, a rear cover 31, and a front cover 32. The rear cover 31 and the front cover 32 are attached to each other, and the inner frame 35 is enclosed by the rear cover 31 and the front cover 32. The rear cover 31 and the front cover 32 forms the outer shape of the ink cartridge 30. The ink chamber 36 is formed in the inner frame 35. In another embodiment, the ink cartridge 35 may not have the inner frame 35, and the rear cover 31 and the front cover 32 may define the ink chamber 36.

The attitude of the ink cartridge 30 shown in FIGS. 3 to 6 and 15 is the mounted attitude, as an example of the first attitude. As described below, the ink cartridge 30 comprises a front face 140, a rear face 41, an upper face 39, 141, and a lower face 42, 142, as outer faces of the ink cartridge 30. When the ink cartridge 30 takes the attitude shown in FIGS. 3 to 6 and 15, the direction extending from the rear face 41 to front face 140 coincides with the insertion direction 51 and the forward direction 57, the direction extending from the front face 140 to the rear face 41 coincides with the removal direction 52 and the rearward direction 58, the direction extending from the upper face 39, 141 to the lower face 42, 142 coincides with the downward direction 53, the direction extending from the lower face 42, 142 to the upper face 39, 141 coincides with the upward direction 54. When the ink cartridge 30 is inserted into and mounted to the cartridge mounting portion 110, the front face 140 faces the insertion direction 51 and the forward direction 57, the rear face 41 faces the removal direction 52 and the rearward direction 58, the lower face 42, 142 faces the downward direction 53, and the upper face 39, 141 faces the upward direction 54.

Referring to FIGS. 3 to 6, the ink cartridge 30 has a width dimension along the right direction 55 and the left direction 56, a height dimension along the downward direction 53 and the upward direction 54, a depth dimension along the forward direction 57 and the rearward direction 58. The width dimension is less than each of the height dimension and the depth dimension. The front cover 32 comprises the front face 140, which faces the insertion direction 51 and the forward direction 57 when the ink cartridge 30 is inserted into the cartridge mounting portion 110, and the rear cover 31 comprises the rear face 41, which faces the removal direction 52 and the rearward direction 58 when the ink cartridge 30 is inserted into the cartridge mounting portion 110. The ink chamber 36 is positioned between the front face 140 and the rear face 41.

[Rear Cover 31]

Figure 3A:
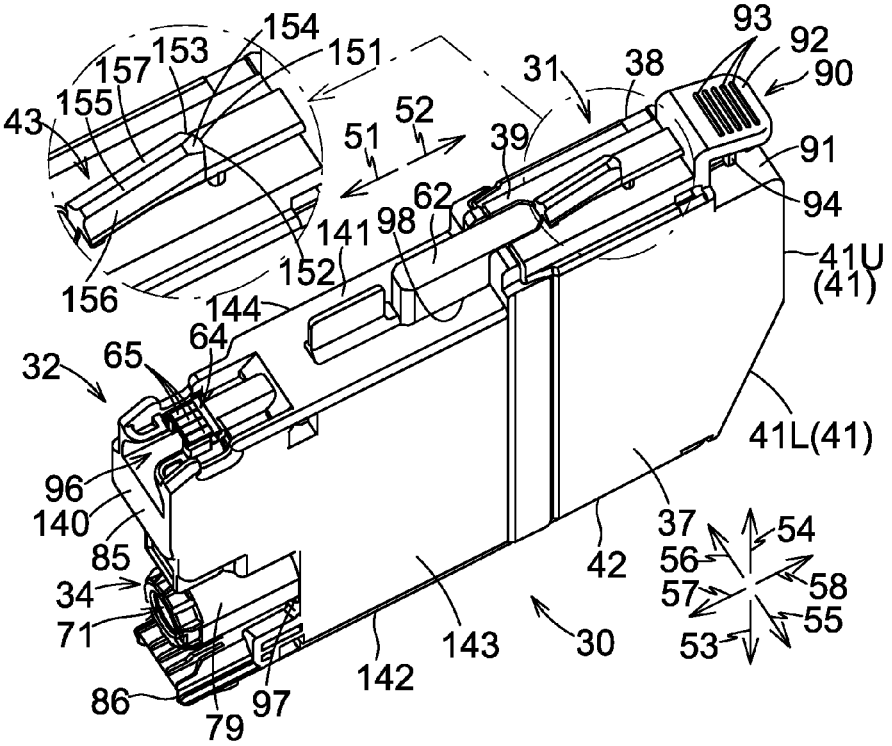
FIG. 3A is a perspective view of the ink cartridge, viewed from front and above.
Figure 3B:
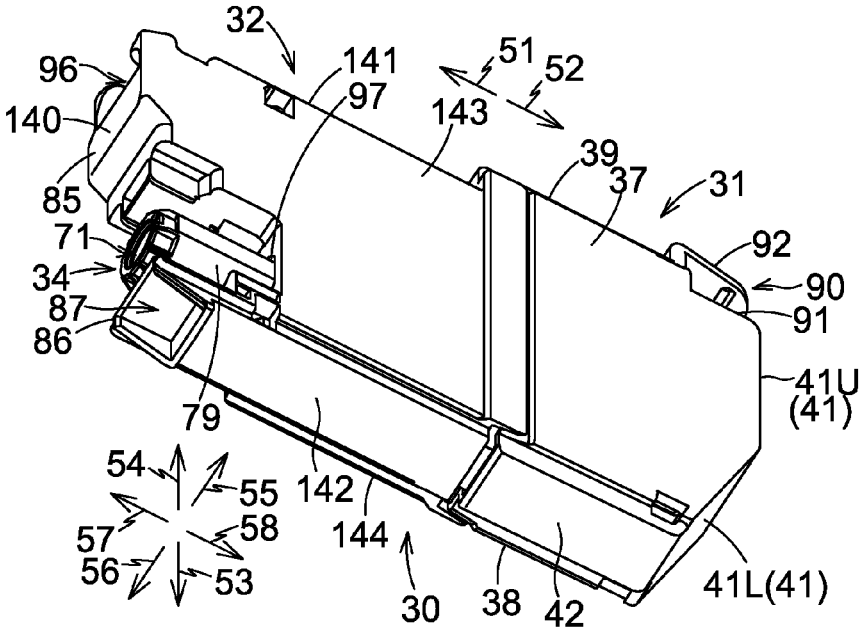
FIG. 3B is a perspective view of the ink cartridge, viewed from front and below.
Figure 4A:
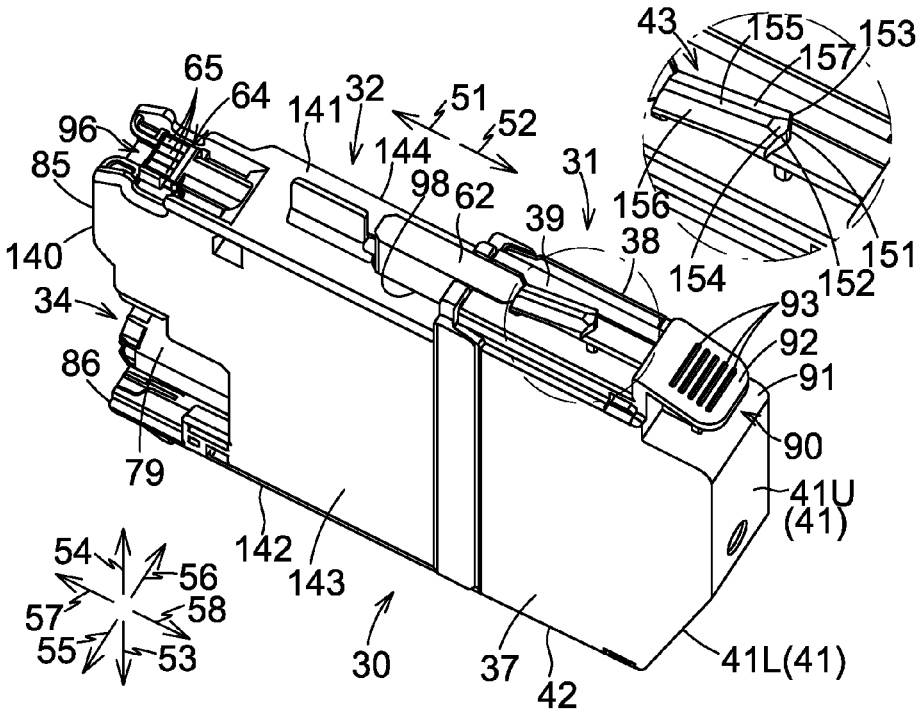
FIG. 4A is a perspective view of the ink cartridge, viewed from behind and above.
Figure 4B:
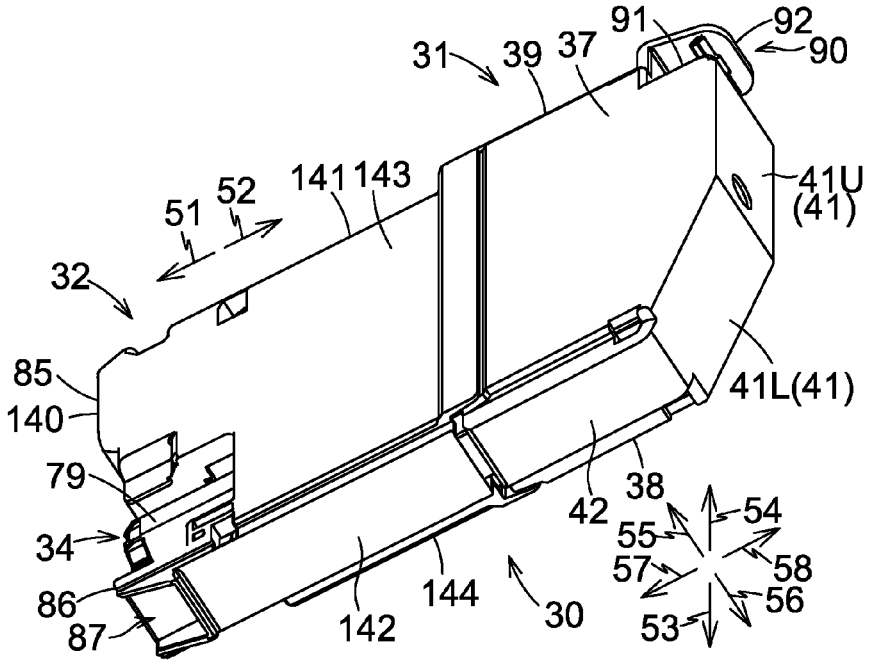
FIG. 4B is a perspective view of the ink cartridge, viewed from behind and below.

Referring to FIGS. 3 and 4, the rear cover 31 has a box shape having side faces 37, 38 spaced apart from each other in the right direction 55 and the left direction 56, the upper face 39 and the lower face 42 spaced apart from each other in the downward direction 53 and the upward direction 54, and the rear face 41. The side faces 37, 38 face the right direction 55 and the left direction 56, respectively, the upper face 39 faces the upward direction 54, and the lower face 42 faces the downward direction 53. The side faces 37, 38, the upper face 39, and the lower face 42 extend from the rear face 41 in the insertion direction 51 and the forward direction 57, and the inner space of the rear cover 31 is opened toward the insertion direction 51 and the forward direction 57. The inner frame 35 is inserted into the inner space of the rear cover 31 from the opening, i.e., the rear cover 31 covers a rear portion of the inner frame 35. The ink chamber 36 is positioned between the upper face 39 and the lower face 42

Figure 15B:
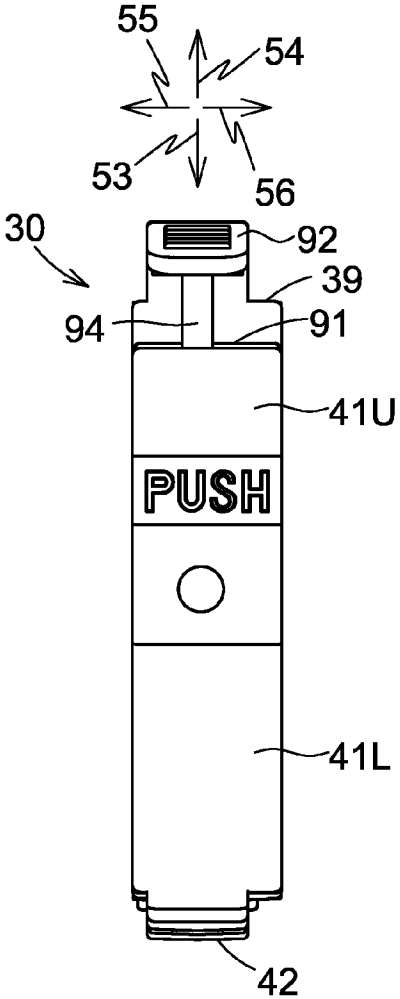
FIG. 15B is a rear view of the ink cartridge viewed in a forward direction.

The rear face 41 comprises an upper portion 41U, as an example of a second portion, and a lower portion 41L, as an example of a first portion. The upper portion 41U is positioned above the lower portion 41L, i.e., the upper portion 41 is positioned further in the upward direction 54 than the lower portion 41L. In other words, the lower portion 41L is positioned below the upper portion 41U, i.e., the lower portion 41L is positioned further in the downward direction 53 than the upper portion 41U. The lower portion 41L is positioned more forward than the upper portion 41U, i.e., the lower portion 41L is positioned further in the forward direction 57 than the upper portion 41U. In this embodiment, each of the upper portion 41U and the lower portion 41L is a plane, i.e., a flat surface. The upper portion 41U and the lower portion 41L intersect each other forming an angle therebetween, which angle is not a right angle. The lower portion 41L is inclined relative to the downward direction 53 and the upward direction 54, such that the lower portion 41L becomes closer to the front face 140 as it approaches to the lower face 42, i.e., the lower portion 41L is closer to the front face 140 at a position closer to the lower face 42. Referring to FIG. 15B, the upper portion 41U comprises a letter or symbol thereon, and the letter or symbol indicates that the upper portion 41U is supposed to be pushed. For instance, the upper portion 41U comprises letters "PUSH" thereon, so that a user may push the upper portion 41U when the user inserts the ink cartridge 30 into the cartridge mounting portion 110. An example of the symbol may be an arrow or a picture of a finger.

Referring to FIGS. 3 and 4, the rear cover 31 comprises a protrusion 43 extending from the upper face 39. The protrusion 43 is positioned at about the center of the upper face 39 in the right direction 55 and the left direction 56, and extends in the insertion direction 51 (the forward direction 57) and the removal direction 52 (the rearward direction 58). The protrusion 43 comprises a lock surface 151 facing the removal direction 52 (the rearward direction 58). The lock surface 151 extends in the upward direction 54 and the downward direction 53. The lock surface 151 is configured to contact the lock portion 145 of the cartridge mounting portion 110 in the removal direction 52 when the ink cartridge is mounted to the cartridge mounting portion 110. By the lock surface 151 contacting the lock portion 145 in the removal direction 52, the ink cartridge 30 is locked or retained in the cartridge mounting portion 110 against the urging force of the pulling spring 114 transmitted via the slider 107 and the urging force of the coil spring 78.

The protrusion 43 comprises reinforcing surfaces 152, 153. The reinforcing surfaces 152, 153 are continuous with and extend from the right end and the left end of the lock surface 151 in the right direction 55 and the left direction 56, respectively. The reinforcing surfaces 152, 153 extend from a virtual plane toward the insertion direction 51 (the forward direction 57), forming acute angles between the reinforcing surfaces 152, 153 and the virtual plane, respectively, which virtual plane includes the lock surface 151 and extends in the downward direction 53, the upward direction 53, the right direction 55, and the left direction 56. The reinforcing surfaces 152, 153 reinforce the strength and the rigidity of the protrusion 43, and therefore a likelihood that the lock surface 151 is damaged is reduced. Because the reinforcing surfaces 152, 153 do not extend more rearward than the lock surface 151, i.e., the reinforcing surfaces 152, 153 do not extend further in the rearward direction 58 than the lock surface 151, the reinforcing surfaces 152, 153 may not contact the lock portion 145 of the cartridge mounting portion 110. Therefore, if the lock surface 145 slides on the lock portion 145, the sliding resistance may not be increased by the reinforcing surfaces 152, 153.

The protrusion 43 comprises a horizontal surface 154 positioned in front of the lock surface 151, i.e., positioned further in the forward direction 57 than the lock surface 151. The horizontal surface 154 is continuous with the lock surface 151. The horizontal surface 154 extends in the right direction 55, the left direction 56, the forward direction 57, and the rearward direction 58. The protrusion 43 comprises an inclined surface 155 in front of the horizontal surface 154, i.e., positioned further in the forward direction 57 than the horizontal surface 154. The inclined surface 155 is continuous with the horizontal surface 154. The inclined surface 155 faces the upward direction 54 and the forward direction 57. Therefore, the inclined surface 155 is viewable when the ink cartridge 30 is viewed in the downward direction 53 and is viewable when the ink cartridge is viewed in the rearward direction 58. Because the horizontal plane 154 is positioned between the lock surface 154 and the inclined surface 155, the lock surface 151 and the inclined surface 155 do not intersect each other at an acute angle. During the insertion of the ink cartridge 30 into the cartridge mounting portion 110, the lock portion 145 of the cartridge mounting portion 145 slides on the inclined surface 155 and the horizontal surface 154 and therefore is smoothly guided to a position more rearward than the lock surface 151, i.e., a position further in the rearward direction 58 than the lock surface 151.

The protrusion 43 comprises reinforcing surfaces 156, 157. The reinforcing surfaces 156, 157 are continuous with and extend from the right end and the left end of the inclined surface 155 in the right direction 55 and the left direction 56, respectively. The reinforcing surfaces 156, 157 extend from a virtual plane toward the downward direction 53 forming acute angles between the reinforcing surfaces 156, 157 and the virtual plane, respectively, which virtual plane includes the inclined surface 155 and extends in the right direction 55 and the left direction 56. The reinforcing surfaces 156, 157 reinforce the strength and the rigidity of the protrusion 43, and therefore a likelihood that the inclined surface 155 is damaged is reduced. Because the reinforcing surfaces 156, 157 do not extend more upward than the inclined surface 155, i.e., the reinforcing surfaces 156, 157 do not extend further in the upward direction 54 than the inclined surface 155, the reinforcing surfaces 156, 157 may not contact the lock portion 145 of the cartridge mounting portion 110. Therefore, if the inclined surface 155 slides on the lock portion 145, the sliding resistance may not be increased by the reinforcing surfaces 156, 157.

The rear cover 31 comprises an operation portion 90 at the upper face 39, and the operation portion 90 is positioned more rearward than the lock surface 151, i.e., positioned further in the rearward direction 58 than the lock surface 151. The upper face 39 comprises a sub upper face 91 positioned at the rear end of the upper face 39. The sub upper face 91 is positioned below the rest of the upper face 39, i.e., the sub upper face 91 is positioned further in the downward direction 53 than the rest of the upper face 39. The operation portion 90 is positioned above the sub upper face 91, i.e., the operation portion 90 is positioned further in the upward direction 54 than the sub upper face 91, with a space formed therebetween. The operation portion 90 extends in the upward direction 54 beyond the protrusion 43 from a position adjacent to the boundary between the sub upper face 91 and the rest of the upper face 39, and then extends obliquely downward, i.e., in the rearward direction 58 and the downward direction 53. The rear cover 31 comprises a rib 94 extending between the operation portion 90 and the sub upper face 91. The rib 94 is continuous with the operation portion 90 and the sub upper face 91. The rib 94 also extends in the rearward direction 58. Referring to FIG.

15B, each of the rib 94, the operation portion 90, and the sub upper face 91 has a dimension along the right direction 55 and the left direction 56, and the dimension of the rib 94 is less than each of the dimension of the operation portion 90 and the dimension of the sub upper face 91 along the right direction 55 and the left direction 56.

The operation portion 90 comprises an operation surface 92 facing the upward direction 54 and the rearward direction 58. In the illustrated embodiments, at least a portion of the operation surface 92 is directly above the sub upper face 91 as shown, for example, in FIG. 14. Thus, he position of the operation surface 92 and the position of the sub upper face 91 along the forward direction 57 and the rearward direction 58 at least partly overlap. In other words, the operation surface 92 and the sub upper face 91 at least partly overlap in the downward direction 53 and the upward direction 54. In other words, at least a portion of the operation surface 92 is aligned with at least a portion of the sub upper face 91 in the downward direction 53 and the upward direction 54, such that both the operation surface 92 and the sub upper face 91 would intersect a virtual line extending in the downward direction 53 and upward direction 54. The operation surface 92 comprises a plurality of protrusions, i.e., a plurality of elongated protrusions 93, each extending in the right direction 55 and the left direction 56. The elongated protrusions 93 are spaced apart from each other in the forward direction 57 and the rearward direction 58. With the elongated protrusions 93, the operation surface 92 becomes recognizable to a user, and the operation surface 92 becomes nonskid when the user operates the operation surface 92 with his/her finger.

Figure 15A:
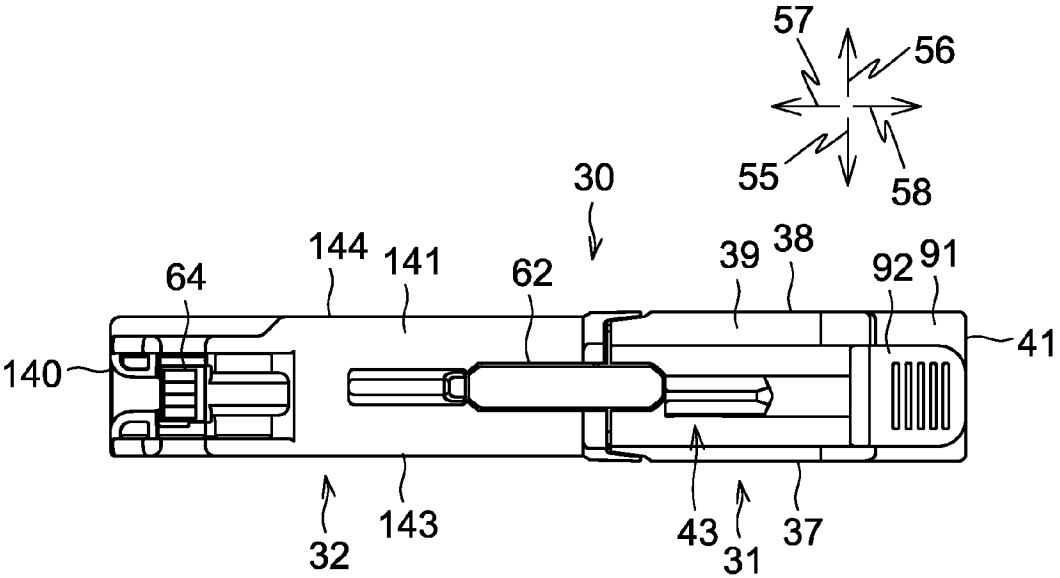
FIG. 15A is a plane view of the ink cartridge viewed in a downward direction.

Referring to FIGS. 15A and 15B, the operation surface 92 is viewable when the ink cartridge 30 is viewed in the downward direction 53 and when the ink cartridge 30 is viewed in the forward direction 57 and the insertion direction 51. In other words, the operation surface is viewable when the ink cartridge 30 is viewed in the direction extending from the upper face 39 toward the lower face 42 and when the ink cartridge 30 is viewed in the direction extending from the rear face 41 toward the front face 140. The operation surface 92 is a surface a user operates for unlocking or releasing the ink cartridge 30 from the locked state in the cartridge mounting portion 110. The operation portion 90 is fixed to the rear cover 31, e.g., the operation portion 90 is integrally molded with the rear cover 31, and therefore the operation portion 90 does not move relative to the rear cover 31, e.g., does not pivot relative to the rear cover 31. Therefore, a force applied to the operation surface 92 from a user is directly transmitted to the rear cover 31, without changing its direction. In this embodiment, the operation portion 90 is fixed relative to, but not necessarily directly to, the inner frame 35 and thus also does not move relative to the inner frame 35 or ink chamber 36, e.g., does not pivot relative to the inner frame 35 or ink chamber 36.

At least a portion of the operation surface 92 protrudes further in the upward direction 54 than the lock surface 151.

[Front Cover 32]

Referring to FIGS. 3 and 4, the front cover 32 has a box shape having side faces 143, 144 spaced apart from each other in the right direction 55 and the left direction 56, the upper face 141 and the lower face 142 spaced apart from each other in the downward direction 53 and the upward direction 54, and the front face 140. The side faces 143, 144 face the right direction 55 and the left direction 56, respectively, the upper face 141 faces the upward direction 54, and the lower face 142 faces the downward direction 53. The side faces 143, 144, the upper face 141, and the lower face 142 extend from the front face 140 in the removal direction 52 and the rearward direction 58, and the inner space of the front cover 32 is opened toward the removal direction 52 and the rearward direction 58. The inner frame 35 is inserted into the inner space of the front cover 32 from the opening. The front cover 32 covers a front portion of the inner frame 35, which is not covered by the rear cover 31. The ink chamber 36 is positioned between the upper face 141 and the lower face 142.

The upper face 141 of the front cover 32 and the upper face 39 of the rear cover 31 constitute the upper face of the ink cartridge 30. The lower face 142 of the front cover 32 and the lower face 42 of the rear cover 31 constitute the lower face of the ink cartridge 30. More specifically, when the ink cartridge 30 is in the mounted attitude (first attitude), the lower face 142 of the front cover 32 extends in the forward direction 57 and the rearward direction 58, and the lower face 42 of the rear cover 31 faces the downward direction 53 and the rearward direction 58. The lower face 42 is inclined relative to the lower face 142. In this embodiment, each of the lower face 42 and the lower face 142 is a plane, i.e., a flat surface. The side faces 143, 144 of the front cover 32 and the side faces 37, 38 of the rear cover 31 constitute the side faces of the ink cartridge 30. The front face 140 of the front cover 32 constitutes the front face of the ink cartridge 30, and the rear face 41 of the rear cover 31 constitutes the rear face of the ink cartridge 30. The front face 140 and the rear face 41 are spaced apart from each other in the forward direction 57 and the rearward direction 58.

Each of the front face, the rear face, the upper face, the lower face, and the side faces of the ink cartridge 30 may not need to form a single flat surface. The front face of the ink cartridge 30 is a face that is viewable when the ink cartridge 30 in the first attitude is viewed in the rearward direction 58 and positioned more forward than the center of the ink cartridge 30 in the first attitude with respect to the forward direction 57 and the rearward direction 58, i.e., positioned further in the forward direction 57 than the center of the ink cartridge 30 in the first attitude with respect to the forward direction 57 and the rearward direction 58. The rear face of the ink cartridge 30 is a face that is viewable when the ink cartridge in the first attitude is viewed in the forward direction 57 and positioned more rearward than the center of the ink cartridge 30 in the first attitude with respect to the forward direction 57 and the rearward direction 58, i.e., positioned further in the rearward direction 58 than the center of the ink cartridge 30 in the first attitude with respect to the forward direction 57 and the rearward direction 58. The upper face of the ink cartridge 30 is a face that is viewable when the ink cartridge 30 in the first attitude is viewed in the downward direction 53 and positioned above the center of the ink cartridge 30 with respect to the downward direction 53 and the upward direction 54, i.e., positioned further in the upward direction 54 than the center of the ink cartridge 30 with respect to the downward direction 53 and the upward direction 54. The lower face of the ink cartridge 30 is a face that is viewable when the ink cartridge 30 in the first attitude is viewed in the upward direction 54 and positioned below the center of the ink cartridge 30 with respect to the downward direction 53 and the upward direction 54, i.e., positioned further in the downward direction 53 than the center of the ink cartridge 30 with respect to the downward direction 53 and the upward direction 54. One of the side faces of the ink cartridge 30 is a face that is viewable when the ink cartridge 30 in the first attitude is viewed in the left direction 56 and positioned to the right of the center of the ink cartridge 30 with respect to the right direction 55 and the left direction 56, i.e., positioned further in the right direction 55 than the center of the ink cartridge 30 with respect to the right direction 55 and the left direction 56. The other one of the side faces of the ink cartridge 30 is a face that is viewable when the ink cartridge 30 in the first attitude is viewed in the right direction 55 and positioned to the left of the center of the ink cartridge 30 with respect to the right direction 55 and the left direction 56, i.e., positioned further in the left direction 56 than the center of the ink cartridge 30 with respect to the right direction 55 and the left direction 56.

The front cover 32 has the recess 96 formed in an upper portion of the front face 140. The recess 96 extends from the front face 140 in the rearward direction 58. The recess 96 is configured to receive the rod 125 when the ink cartridge 30 is mounted to the cartridge mounting portion 110. The recess 96 has a cross-sectional shape taken along a plane perpendicular to the forward direction 57 and the rearward direction 58, and the cross-sectional shape of the recess 96 corresponds to the cross-sectional shape of the rod 125.

The front cover 32 has an opening 97 formed through a lower portion of the front face 140 in the rearward direction 58. The opening 97 is configured to allow the ink supply portion 34 to extend therethrough when the inner frame 35 is inserted into the front cover 32, such that the ink supply portion 34 is positioned outside of the front cover 32. The position, dimension, and shape of the opening 97 correspond to those of the ink supply portion 34.

The front cover 32 comprises a first protrusion 85 and the second protrusion 86 positioned at the front face 140. The first protrusion 85 extends in the forward direction 57 at the upper end of the front cover 32. The recess 96 is formed in the distal end of the first protrusion 57 facing the forward direction 57. The distal end of the first protrusion 57 facing the forward direction 57 is a part of the front face 140.

The second protrusion 86 extends in the forward direction 57 at the lower end of the front cover 32. The second protrusion 86 is positioned below the ink supply portion 34, i.e., positioned further in the downward direction 53 than the ink supply portion 34. The protrusion 86 has a recess 87 formed in its lower face, and the recess 87 opens in the forward direction 57 and the downward direction 53. A portion of the second protrusion 86 defining the recess 87 extends beyond the lower face 142 of the front cover 32 in the downward direction 53. During the insertion of the ink cartridge 30 into the cartridge mounting portion 110, the slider 107 enters the recess 87 and contacts the portion of the second protrusion 86 defining the recess 87. The second protrusion 86 is an example of a receive portion.

The front cover 32 has an opening 98 formed through the upper face 141 in the downward direction 53. The opening 98 is configured to allow a portion of the detection portion 62 to extend therethrough when the inner frame 35 is inserted into the front cover 32, such that the detection portion 62 is positioned outside of the front cover 32. The position, dimension, and the shape of the opening 98 correspond to those of the portion of the detection portion 62.

The ink cartridge 30 comprises an IC board 64 positioned at the upper face 141 of the front cover 32 above the first protrusion 85 and the ink supply portion 34, i.e., further in the upward direction 54 than the first protrusion 85 and the ink supply portion 34. The IC board 64 comprises four electrodes 65 formed thereon. The four electrodes 65 are exposed and face the upward direction 54. Each electrode 65 is an example of an electrical interface. The four electrodes 65 are aligned with and spaced apart from each other in the left direction 56 and the right direction 55. Each electrode 65 is elongated in the forward direction 57 and the rearward direction 58. The IC board 64 also comprises an IC (Integrated Circuit, not shown), and the four electrodes 65 are electrically connected to the IC. The IC stores information about the ink cartridge 30, such as the lot number, the manufactured date, the color of ink, etc. The information can be read out from the outside.

During the insertion of the ink cartridge 30 into the cartridge mounting portion 100 and also when the mounting of the ink cartridge 30 to the cartridge mounting portion 100 is completed, the four electrodes 65 contact the four contacts 106 of the cartridge mounting portion 110.

[Inner Frame 35]

Although not shown in the drawings in detail, the inner frame 35 comprises an annular or loop shaped wall, and the inner space surrounded by the wall opens in the right direction 55 and the left direction 56 at the right and left ends of the inner frame 35, respectively. Films (not shown) are attached to the right and left ends of the inner frame 35, such that the inner space of the inner frame 35 is closed, and the inner space becomes the ink chamber 36 configured to store ink therein. The inner frame 35 comprises a front face 40, and the ink supply portion 34 is positioned at the front face 40. The front face 40 of the inner frame 35 is positioned adjacent to the front face 140 of the front cover 32, when the inner frame 35 is inserted into the front cover 32.

[Ink supply Portion 34]

Figure 6:
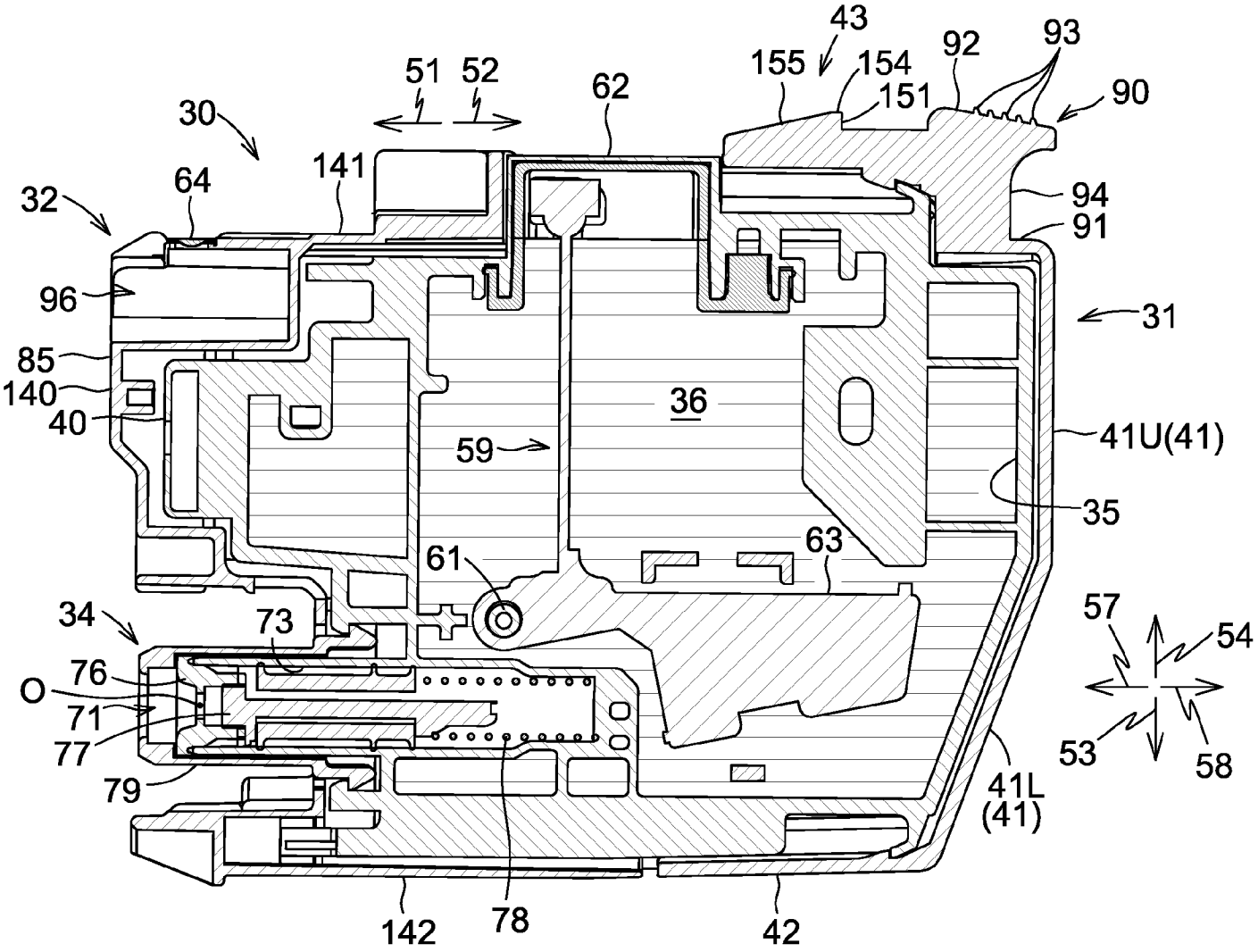
FIG. 6 is a vertical cross-sectional view of the ink cartridge, showing the inside of the ink cartridge.

Referring to FIG. 6, the ink supply portion 34 extends from the front face 40 of the inner frame 35 in the forward direction 57 to the outside of the front cover 32 through the opening 97 formed through the front face 140 of the front cover 32. The ink supply portion 34 has a circular cylindrical outer shape. The ink supply portion 34 comprises the cylindrical wall 73 having a circular cylindrical shape having an inner space, a seal member 76, and a cap 79. The seal member 76 and the cap 79 are attached to the cylindrical wall 73.

The cylindrical wall 73 extends from the inside of the ink chamber 36 to the outside of the ink chamber 36. The inner space of the cylindrical wall 73 opens to the ink chamber 36 at the rear end of the cylindrical wall 73. The inner space of the cylindrical wall 73 opens to the outside of the ink cartridge 30 at the front end of the cylindrical wall 73. Communication between the ink chamber 36 and the outside of the ink cartridge 30 is allowed via the inner space of the cylindrical wall 73. The ink supply portion 34 is configured to supply ink stored in the ink chamber 36 to the outside of the ink cartridge 30 through the inner space of the cylindrical wall 73. The seal member 76 and the cap 79 are attached to the front end of the cylindrical wall 73.

The ink supply portion 34 comprises the valve 77 and the coil spring 78 positioned in the inner space of the cylindrical wall 73. The valve 77 and the coil spring 78 are configured to switch the state of the ink supply portion 34 between a state in which ink is allowed to flow out of the ink chamber 30 through the inner space of the cylindrical wall 73 to the outside of the ink cartridge 30 (see FIG. 11) and a state in which ink is prevented from flowing out of the inner space of the cylindrical wall 73 to the outside of the ink cartridge 30 (see FIG. 6).

The valve 77 is configured to move in the forward direction 57 and the rearward direction 58 to selectively open and close the ink supply opening 71 formed through the center of the seal member 76. The coil spring 78 is configured to urge the valve 77 in the forward direction 57 (the insertion direction 51), such that the valve 77 contacts the seal member 76 and close the ink supply opening 71 when an external force is not applied to the valve 77.

The seal member 76 is positioned at the front end of the cylindrical wall 73. The seal member 76 has substantially a disc shape having the ink supply opening 71 formed therethrough in the forward direction 57 and the rearward direction 58 (the insertion direction 51 and the removal direction 52). The seal member 76 is made of an elastic material such as rubber, elastomer, etc. The diameter of the ink supply opening 71 is slightly less than the outer diameter of the ink supply tube 102. The seal member 76 liquid-tightly contacts the front end of the cylindrical wall 73 while being pressed by the cap 79 which is attached to and covers the outside of the cylindrical wall 73.

Before the ink cartridge 30 is inserted into the cartridge mounting portion 110, the valve 77 closes the ink supply opening 71. When the ink cartridge 30 is inserted into the cartridge mounting portion 110, the ink supply tube 102 enters the ink supply opening 71. When this occur, the inner surface of the seal member 76 defining the ink supply opening 71 liquid-tightly contacts the outer surface of the ink supply tube 102 while the seal member 76 is elastically deformed by the outer surface of the ink supply tube 102. When the ink cartridge 30 is further inserted, the end of the ink supply tube 102 passes through the ink supply opening 71 and contacts the valve 77. When the ink cartridge 30 is further inserted, the ink supply tube 102 pushes and moves the valve 77 in the rearward direction 58 against the urging force of the coil spring 78. When this occurs, ink is allowed to flow from the ink chamber 36 to the ink supply tube 102 through the inner space of the cylindrical wall 73. Although not shown in the drawings, the ink supply tube 102 has an opening at or adjacent to the end of the ink supply tube 102, and the opening extends from the outer surface of the ink supply tube 102 to the inner space of the ink supply tube 102. Ink flows from the inner space of the cylindrical wall 73 to the inner space of the ink supply tube 102 via the opening of the ink supply tube 102. Ink flows from the ink chamber 36 to the outside of the ink cartridge 30 through the inner space of the cylindrical wall 73 and the inner space of the ink supply tube 102.

The ink supply portion 34 may not necessarily comprise the valve 77 and the coil spring 78. For instance, in another embodiment, the ink supply opening 71 may be closed by a film. In such an embodiment, when the ink cartridge 30 is inserted into the cartridge mounting portion 110, the ink supply tube 102 penetrates through the film and passes through the ink supply opening 71, such that the end of the ink supply tube 102 is positioned in the inner space of the cylindrical wall 73. In yet another embodiment, the ink supply opening 71 may be closed by the elasticity of the seal member 76. In such an embodiment, when the ink cartridge 30 is inserted into the cartridge mounting portion 110, the outer surface of the ink supply tube 102 pushes the inner surface of the seal member 76 defining the ink supply opening 71 radially, and thereby opens the ink supply opening 71.

[Detection Portion 62]

Referring to FIG. 6, the inner frame 35 comprises the detection portion 62 extending from the upper face of the inner frame 35 in the upward direction 54. The detection portion 62 is a protrusion having an inner space continuous with the ink chamber 36. The detection portion 62 is configured to allow light to pass therethrough in the right direction 55 and the left direction 56. The detection portion 62 extends through the opening 98 of the front cover 32 to the outside of the ink cartridge 30.

Referring to FIG. 6, the ink cartridge 30 comprises a detection member 59 positioned in the ink chamber 36. The inner frame 35 comprises a pivot shaft 61 extending in the right direction 55 and the left direction 56, and the detection member 59 is supported by the pivot shaft 61, such that the detection member 59 can pivot about the pivot shaft 61.

The detection portion 59 comprises a float 63, and the float 63 has a specific gravity which is less than the specific gravity of ink stored in the ink chamber 36. When the float 63 is submerged in ink stored in the ink chamber 36, a buoyancy force acts on the float 63. When the ink chamber 36 is almost filled with ink, the detection member 59 pivots counterclockwise (as viewed in FIG. 6) due to the buoyancy force acting on the float 63. A portion of the detection member 59 is positioned in the inner space of the detection portion 62 and contacts the wall of the detection portion 62 defining the front end of the detection portion 62, such that the detection member 59 does not pivot further in the counterclockwise direction. When the detection member 59 is in this position, the portion of the detection member 59 blocks the light of the sensor 103 passing through the detection portion 62 in the right direction 55 and the left direction 56. More specifically, because the portion of the detection member 59 blocks the light, when the light emitted from the light emitting portion of the sensor 103 reaches one of the right face and the left face of the detection portion 62, the intensity of light coming out of the other of the right face and the left face of the detection portion 62 and reaching the light receiving portion of the sensor 103 becomes less than the threshold value, e.g., zero. The portion of the detection member 59 may completely prevent the light from passing therethrough in the right direction 55 and the left direction 56, may partly absorb the light, may alter the path of the light, or totally reflect the light.

When ink is consumed from the ink chamber 36, the ink surface in the ink chamber 36 lowers and an upper portion of the float 63 is exposed from the ink surface. When the ink surface further lowers, the float 63 moves down, following the lowering ink surface. When this occurs, the detection member 59 pivots clockwise in FIG. 6, and the portion of the detection member 59 in the inner space of the detection portion 62 moves out of the optical path extending between the light emitting portion and the light receiving portion of the sensor 103. When this occurs, the light of the sensor 103 is no longer blocked by the portion of the detection member 59, and the intensity of light received by the light receiving portion of the sensor 103 becomes greater than or equal to the threshold value.

Figure 5:
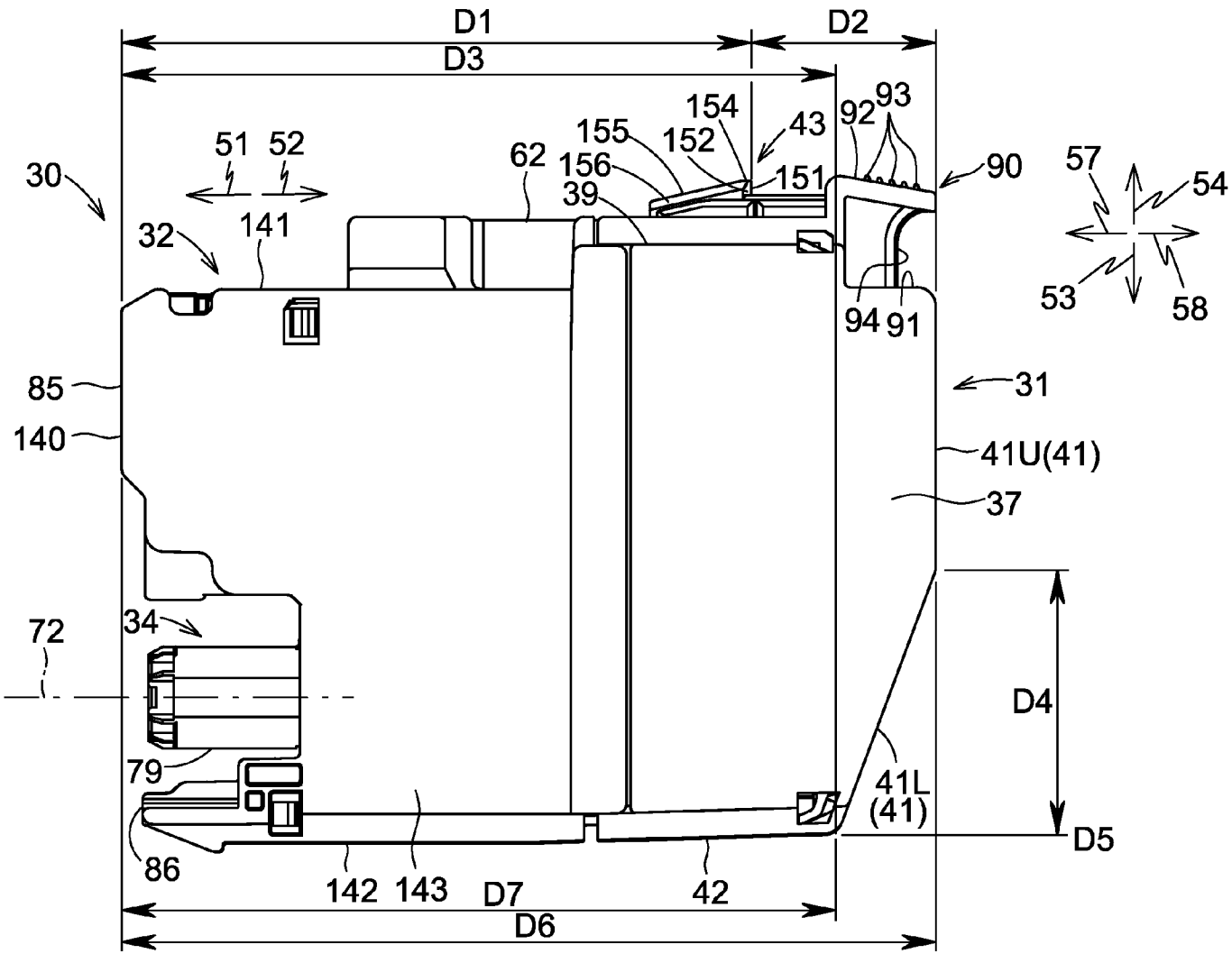
FIG. 5 is a side view of the ink cartridge.

Referring to FIG. 5, a distance D1 from the lock surface 151 (more specifically, the foremost part of the lock surface 151) to the front face 140 (more specifically, the foremost part of the front face 140) in the insertion direction 51 (the forward direction 57) is greater a distance D2 from the lock surface 151 (more specifically, the rearmost part of the lock surface 151) to the rear face 41 (more specifically, the rearmost part of the upper portion 41U of the rear face 41) in the removal direction 52 (the rearward direction 58). The distance D1 is less than a distance D3 from the operation surface 92 (more specifically, the foremost part of the operation surface 92) to the front face 140 (more specifically, the foremost part of the front face 140) in the insertion direction 51 (the forward direction 57). A distance D4 from the upper portion 41U (more specifically, the lowermost part of the upper portion 41U) to the lower face 42 (more specifically, the uppermost part of the lower face 42) in the downward direction 53 is greater than a distance D5 from the lower portion 41L (more specifically, the lowermost part of the lower portion 41L) to the lower face 42 (more specifically, the uppermost part of the lower face 42) in the downward direction 53. In this embodiment the distance D5 is zero. A distance D6 from the upper portion 41U (more specifically, the foremost part of the upper portion 41U) to the front face 140 (more specifically, the foremost part of the front face 140) in the insertion direction 51 (the forward direction 57) is greater than a distance D7 from the lower portion 41L (more specifically, the foremost part of the lower portion 41L) to the front face 140 (more specifically, the foremost part of the front face 140) in the insertion direction 51 (the forward direction 57). The lower portion 41L comprises a portion positioned between a central axis 72 of the ink supply opening 71 of the seal member 76 and the lower face 42 in the downward direction 53. The central axis 72 of the ink supply opening 71 intersects the center of the ink supply opening 71 and extends in the direction in which the ink supply opening 71 penetrates through the seal member 76, i.e., in the forward direction 57 and the rearward direction 58 in this embodiment. The center of the ink supply opening 71 is the center of at least a portion of the ink supply opening 71, and the inner surface of the seal member 76 defining the at least a portion of the ink supply opening 71 contacts the outer surface of the ink supply tube 102 when the ink supply tube 102 is inserted through the ink supply opening 71. For instance, if the inner surface of the seal member 76 defining the ink supply opening 71 has a first inner surface and a second inner surface, and the first inner surface contacts the outer surface of the ink supply tube 102 while the second inner surface does not, the center of the ink supply opening 71 is the center of a portion of the ink supply opening 71 defined by the first inner surface, but not by the second inner surface. If the entire inner surface of the seal member 76 contacts the outer surface of the ink supply tube 102, the center of the ink supply opening 71 is the center of the entirety of the ink supply opening 71.

[Insertion of Ink Cartridge 30 Into Cartridge Mounting Portion 110]

Referring to FIG. 6, before the ink cartridge 30 is inserted into the cartridge mounting portion 110, the valve 77 closes the ink supply opening 71. The flow of ink from the ink chamber 36 to the outside of the ink cartridge 30 is blocked.

Referring to FIG. 7, the ink cartridge 30 is inserted into the case 101 via the opening 112 of the cartridge mounting portion 110. The upper portion 41U of the rear face 41 of the rear cover 31 is positioned more rearward than the lower portion 41L of the rear face 41, i.e., the upper portion 41U is positioned further in the rearward direction 58 than the lower portion 41L of the rear face 41. Therefore, the upper portion 41U is positioned closer to a user than the lower portion 41L is positioned to the user, and the user tends to push the upper portion 41U to insert the ink cartridge 30 in the insertion direction 51 into the cartridge mounting portion 110. Moreover, because the upper portion 41U comprises the letter or symbol indicating that the upper portion 41U is supposed to be pushed, the user is urged to push the upper portion 41U. A lower portion of the front cover 32 is positioned in the guide groove 109 of the lower portion of the case 101. More specifically, the portion of the second protrusion 86 defining the recess 87 and extending beyond the lower face 142 of the front cover 32 contacts the groove bottom wall of the guide groove 109, and a rear portion of the lower face 142 of the front cover 32 also contacts the groove bottom wall of the guide groove 109. Therefore, a front portion of the front cover 32 is slightly lifted up.

Referring to FIG. 8, when the ink cartridge 30 is further inserted into the cartridge mounting portion 110, the slider 107 enters the recess 87 and contacts the second protrusion 86 of the ink cartridge 30. Because the user pushes the upper portion 41U of the rear face 41 of the ink cartridge 30, the ink cartridge 30 pivots counterclockwise in FIG. 8 about the contact point between the slider 107 and the second protrusion 86. When this occurs, the lower face 142 of the front cover 32 moves away from the groove bottom wall of the guide groove 109 of the lower portion of the case 101, and an upper portion of the ink cartridge 30 moves closer to the guide groove 109 of the upper portion of the case 101.

Figure 9:
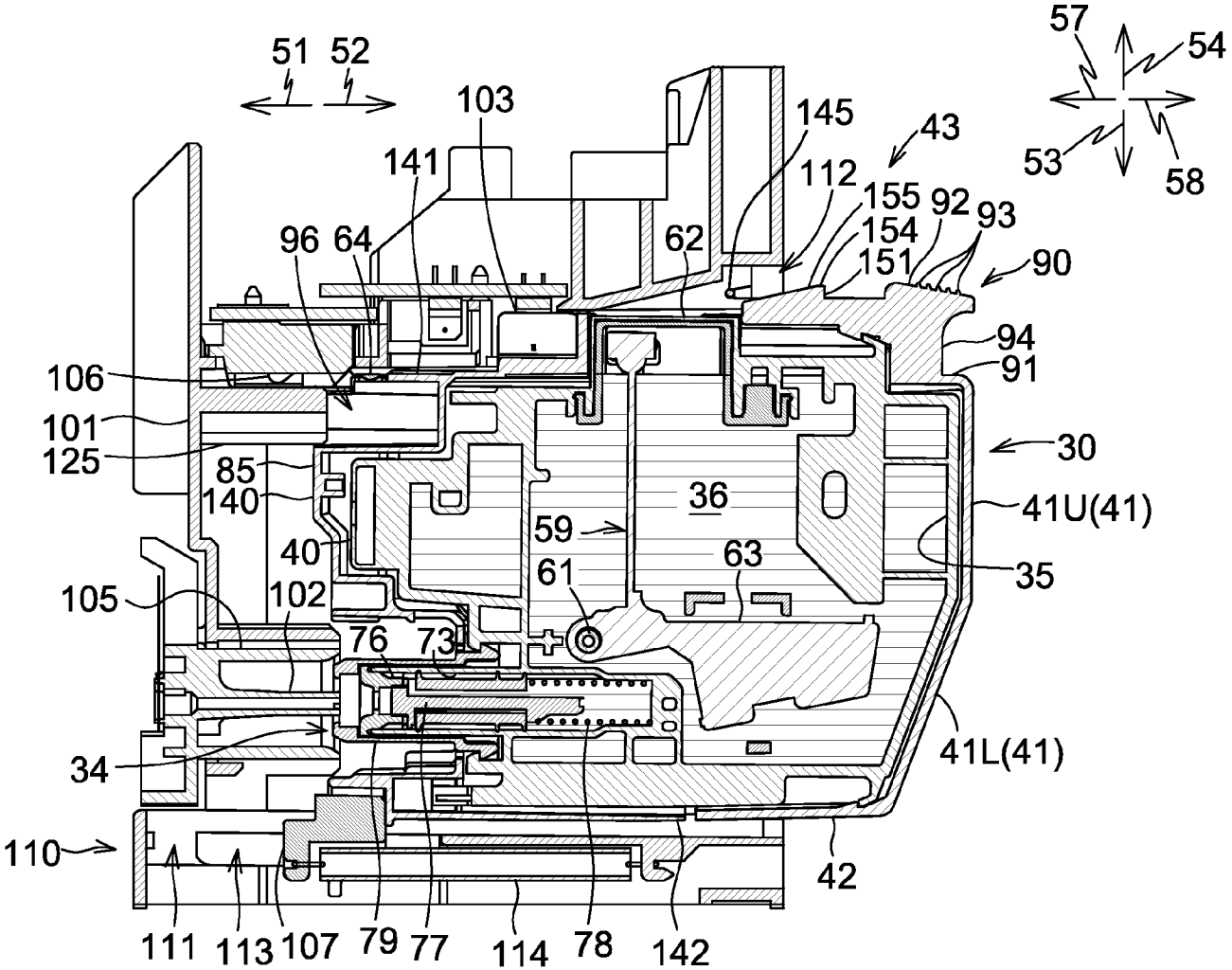
FIG. 9 is a vertical cross-sectional view of the ink cartridge and the cartridge mounting portion, in which an ink supply portion has started to enter a guide portion, and a rod has started to enter a recess of a front cover.

Referring to FIG. 9, when the ink cartridge 30 is further inserted in the insertion direction 51 against the urging force of the pulling spring 114 urging the slider 107 in the removal direction 52, the cap 79 of the ink supply portion 34 starts to enter the guide portion 105, and the rod 125 starts to enter the recess 96.

Referring to FIG. 10, when the ink cartridge 30 is further inserted in the insertion direction 51 against the urging force of the pulling spring 114 that urges the slider 107 in the removal direction 52, the ink supply tube 102 enters the ink supply opening 71 and pushes the valve 77 away from the seal member 76 against the urging force of the coil spring 78. The urging force of the pulling spring 114 is applied to the ink cartridge 30 via the slider 107 in the removal direction 52, and the urging force of the coil spring 78 is applied to the ink cartridge 30 in the removal direction 52.

The rod 125 in the recess 96 supports the front cover 32 from below. The IC board 64 reaches a position below the contacts 106, and electrodes 65 contact the corresponding contacts 106, respectively, while elastically deforming the contacts 106 in the upward direction 54. When this occurs, the IC board 64 is urged in the downward direction 53 by the elastically deformed contacts 106, but the IC board 64 is supported from below by the rod 125. Therefore, the electrodes 65 are accurately positioned relative to the contacts 106 in the upward direction 54 and the downward direction 53. Nevertheless, the rod 125 may not necessarily support the front cover 32 in other embodiments.

Referring to FIG. 10, the protrusion 43 of the rear cover 31 reaches the lock portion 145, and the inclined surface 155 and the horizontal surface 154 slides on the lock portion 145. Although a counterclockwise moment of force is applied to the ink cartridge 30 because the user pushes the upper portion 41U of the rear face 41 in the insertion direction 51, the sliding contact between the inclined surface 155 and the lock portion 145 causes the ink cartridge 30 to pivot clockwise about a pivot center O which is the center of the ink supply opening 71 through which the ink supply tube 102 is inserted, i.e., the center of a portion of ink supply tube 102, which portion contacts the inner surface of the seal member 76 defining the ink supply opening 71. The attitude of the ink cartridge 30 in FIG. 10 is an example of a second attitude.

When the ink cartridge 30 is in the second attitude, the lock surface 151 of the protrusion 43 is positioned below the lock portion 145, i.e., positioned further in the downward direction 53 than the lock portion 145. As pictured in FIG. 10, when the ink cartridge 30 is in the second attitude, the pivot center O is directly below the IC board 64 such that the position of the pivot center O and the positions of the electrodes 65 on the IC board 64 along the insertion direction 51 and the removal direction 52 at least partly overlap. In other words, the IC board 64 would intersect a virtual line extending from the pivot center O in the upward direction 54. Therefore, the magnitude of a moment of force generated by the urging force of the contacts 106 pushing down the electrodes 65 and applied to the ink cartridge 30 is zero or very small. When the ink cartridge 30 is in the second attitude, the lower face 42 of the rear cover 31 contacts or is positioned closer to the groove bottom wall of the guide groove 109 of the lower portion of the case 101. In this embodiment, when the ink cartridge 30 is in the second attitude, the lower face 42 extends in a horizontal plane. When the ink cartridge 30 is in the second attitude, the lower portion 41L of the rear face 41 is positioned more forward than the upper portion 41U of the rear face 41, i.e., positioned further in the insertion direction 51 than the upper portion 41U.

Figure 11:
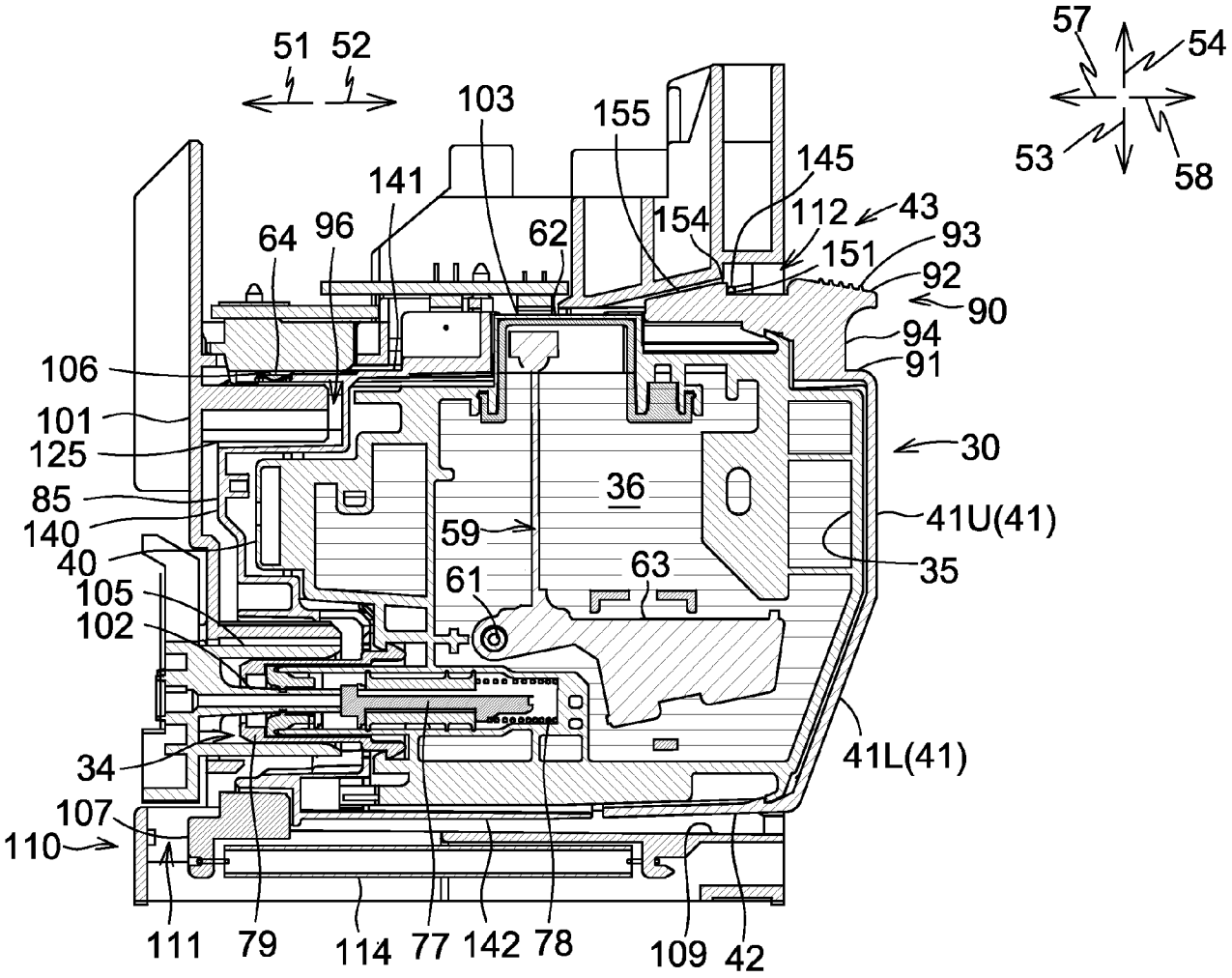
FIG. 11 is a vertical cross-sectional view of the ink cartridge and the cartridge mounting portion, in which the ink cartridge is locked in the cartridge mounting portion.

Referring to FIG. 11, when the ink cartridge 30 is further inserted in the insertion direction 51 against the urging force of the pulling spring 114 that urges the slider 107 in the removal direction 52 and against the urging force of the coil spring 78, the inclined surface 155 and the horizontal surface 154 are positioned further in the insertion direction 51 than the lock portion 145. Because the counterclockwise moment of force, which is generated by the user pushing the upper portion 41U of the rear face 41 in the insertion direction 51, is applied to the ink cartridge 30, when the inclined surface 155 and the horizontal surface 154 do not contact the lock portion 145, the ink cartridge 30 pivots counterclockwise about the pivot center O which is the center of the ink supply opening 71 through which the ink supply tube 102 is inserted.

When the ink cartridge 30 pivots counterclockwise, the lock surface 151 reaches a position in which the lock surface 151 and the lock portion 145 face each other in the insertion direction 51 and the removal direction 52. Moreover, when the ink cartridge 30 pivots counterclockwise, the rear cover 31 contacts the lock portion 145. When this occurs, the impact of the contact tells the user that the insertion of the ink cartridge 30 is completed. When the user stops pushing the ink cartridge 30, the ink cartridge 30 is moved in the removal direction 52 by the urging force of the pulling spring 114 applied via the slider 107 and the urging force of the coil spring 78. When this occurs, the lock surface 151 contacts the lock portion 145 in the removal direction 52 and the movement of the ink cartridge 30 relative to the cartridge mounting portion 110 in the removal direction 52 is restricted, as shown in FIG. 11. The attitude of the ink cartridge 30 in FIG. 11 is an example of the first attitude. The mounting of the ink cartridge 30 to the cartridge mounting portion 110 is thus completed. The ink cartridge 30 is locked or retained in the cartridge mounting portion 110 with the lock surface 151 contacting the lock portion 145 in the removal direction 52 against the urging force of the pulling spring 114 and the urging force of the coil spring 78 in the removal direction 52.

In the following paragraphs, the pivotal movement of the ink cartridge 30 from the second attitude to the first attitude is described in more detail.

Figure 12:
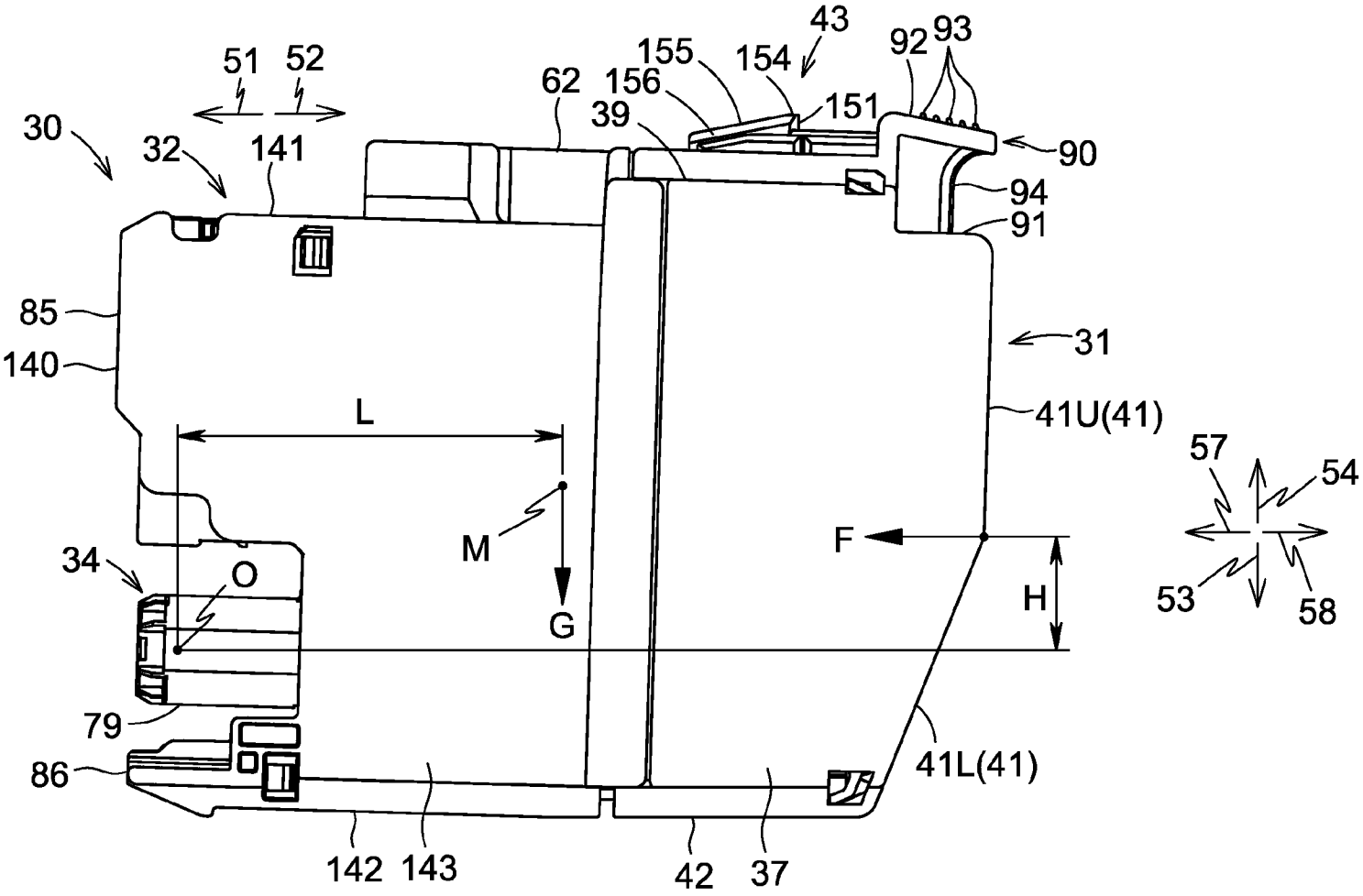
FIG. 12 is a side view of the ink cartridge in the second attitude, in which a force is applied to an upper portion of a rear face.

Referring to FIG. 12, the following condition is satisfied:

$$FH>GL.$$

G is the magnitude of the gravitational force acting on the ink cartridge 30. F is the magnitude of the urging force of the pulling spring 114 and the coil spring 78 urging the ink cartridge 30 in the removal direction 52 when the ink cartridge 30 is in the first attitude. L is the distance between the center of gravity M of the ink cartridge 30 and the pivot center O along the insertion direction 51 when the ink cartridge 30 is in the second attitude. H is the height of the lower end of the upper portion 41U of the rear face 41 from the pivot center O along the upward direction 54 which is perpendicular to the insertion direction 51 when the ink cartridge 30 is in the second attitude.

When a user inserts the ink cartridge 30 into the cartridge mounting portion 110, the user needs to push the ink cartridge 30 in the insertion direction 51 with a force whose magnitude U is greater than the magnitude F of the urging force in the removal direction 52. In other words, the following condition needs to be met: F<U. Moreover, the user pushes the upper portion 41U of the rear face 41, i.e., pushes a portion above the lower end of the upper portion 41U. Therefore, when the ink cartridge 30 is inserted into the cartridge mounting portion 110, a force is applied to the portion above the lower end of the upper portion 41U of the ink cartridge 30 in the insertion direction 51, whose magnitude U is greater than the magnitude F of the urging force. Because the upper portion 41U is substantially perpendicular to the insertion direction 51 when the ink cartridge 30 is in the second attitude, a counterclockwise moment of force is applied to the ink cartridge 30, whose magnitude is at least greater than the product FH. On the other hand, a clockwise moment of force, which is generated by the gravitational force, is applied to the ink cartridge, whose magnitude is the product GL Because the above-described condition FH>GL is met, the overall moment of force applied to the ink cartridge 30 is directed counterclockwise when the ink cartridge 30 is inserted into the cartridge mounting portion 110. Therefore, when the inclined surface 155 and the horizontal surface 154 finish sliding on the lock portion 145 and separate from the lock portion 145 in the insertion direction 51, the counterclockwise moment of force causes the ink cartridge 30 to pivot from the second attitude to the first attitude.

The magnitude G of the gravitational force acting on the ink cartridge 30 varies depending on the amount of ink stored in the ink cartridge 30. Nevertheless, if the condition FH>GL is satisfied when a fresh ink cartridge 30 having an initial amount of ink is inserted, the condition is also satisfied when a used ink cartridge 30 whose amount of ink is relatively low is inserted. That is because the product GL becomes smaller as the amount of ink is reduced while the product FH is unchanged.

Moreover, because the second protrusion 86 of the ink cartridge 30 receives the urging force of the pulling spring 114 via the slider 107 below the pivot center O, the urging force of the pulling spring 114 also generates an additional moment of force causing the ink cartridge 30 to pivot counterclockwise. Nevertheless, even if the moment of force generated by the pulling spring 114 were not applied to the ink cartridge 30, the overall moment of force applied to the ink cartridge 30 would still be directed counterclockwise.

Figure 14:
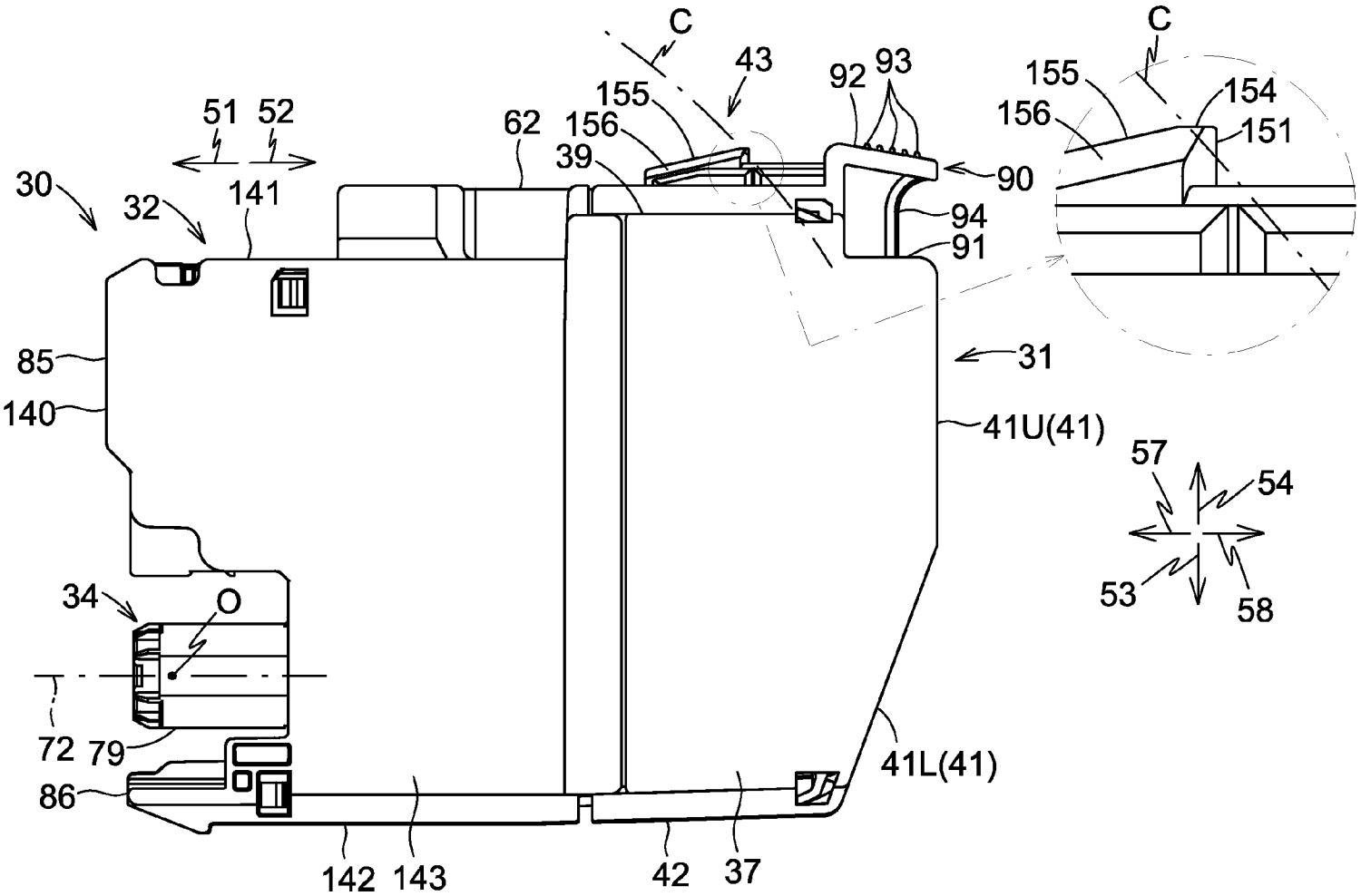
FIG. 14 is a side view of the ink cartridge in the first attitude, in which a virtual circle is shown.

Referring to FIG. 14, when the ink cartridge 30 is in the first attitude, the upper end of the lock surface 151 is positioned outside of a virtual circle C, and the lower end of the lock surface 151 is positioned within the virtual circle C. The virtual circle C has its center at the pivot center O and intersects the lock portion 145. Therefore, when the urging force is applied to the ink cartridge 30 in the removal direction 52 while the lock surface 151 contacts the lock portion 145, the lock portion 145 slides on the lock surface 151 toward the lower end of the lock surface 151. That is, the ink cartridge 30 pivots further counterclockwise when the lock portion 145 and the lock surface 151 contact.

Figure 13:
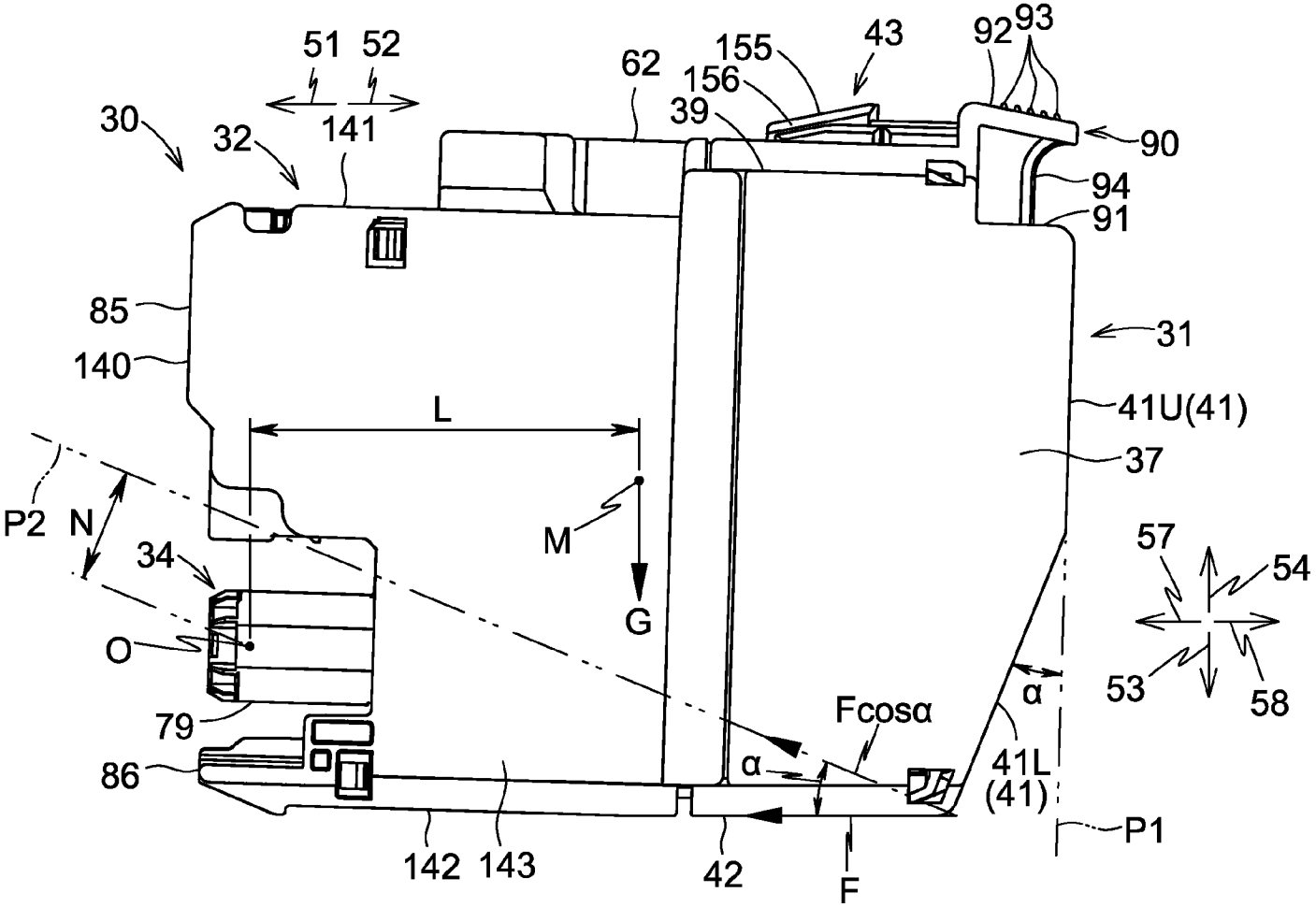
FIG. 13 is a side view of the ink cartridge in the second attitude, in which a force is applied to a lower portion of a rear face.

Referring to FIG. 13, a user may push the lower portion 41L of the rear face 41 instead of the upper portion 41U of the rear face 41 when the user inserts the ink cartridge 30 into the cartridge mounting portion 110. Nevertheless, because the following condition is satisfied, the ink cartridge 30 can pivot counterclockwise in FIG. 13:

$(F \cos \alpha)N>GL$.

The lower portion 41L is a plane intersecting a first virtual plane P1 at an angle of α degrees when the ink cartridge 30 is in the second attitude, and the first virtual plane P1 is perpendicular to the insertion direction 51. N is a length of a perpendicular line extending from the pivot center O to a second virtual plane P2 which is perpendicular to the lower portion 41L and intersects the lower end of the lower portion 41L.

When a user pushes the lower portion 41L in the insertion direction 51 with a force whose magnitude is greater than the magnitude F of the urging force, a counterclockwise moment of force is applied to the ink cartridge 30, whose magnitude is at least greater than the product (Fcosa)N. Because the above-described condition (F cos α)N>GL is met, the overall moment of force applied to the ink cartridge 30 is directed counterclockwise even when the user pushes the lower portion 41L in the insertion direction 51.

When a user wishes to remove the ink cartridge 30 from the cartridge mounting portion 110, the user pushes down the operation surface 92. Referring to FIGS. 15A and 15B, when the ink cartridge 30 is in the first attitude, the operation surface 92 is viewable when the ink cartridge 30 is viewed in the downward direction 53 and is viewable when the ink cartridge 30 is viewed in the forward direction 57 (the insertion direction 51). In other words, when the ink cartridge 30 is in the first attitude, the operation surface 92 faces the upward direction 54 and the rearward direction 58 (the removal direction 52). Therefore, when the user pushes the operation surface 92 when the ink cartridge 30 is in the first attitude to release the ink cartridge 30, the user's force is directed toward the downward direction 53 and the forward direction 57 (the insertion direction 51). Due to the force directed toward the forward direction 57 (the insertion direction 51), the lock surface 151 separates from the lock portion 145. Due to the force directed toward the downward direction 53, the ink cartridge 30 pivots from the first attitude to the second attitude. Therefore, compared to a situation in which the ink cartridge 30 pivots from the first attitude to the second attitude while the lock surface 151 slides on the lock portion 145, the force needed to be applied to the operation surface 92 to cause the ink cartridge 30 to pivot from the first attitude to the second attitude becomes smaller, and the user can readily release the ink cartridge 30.

When the ink cartridge 30 pivots from the first attitude to the second attitude, the lock surface 151 is positioned below the lock portion 145, i.e., positioned further in the downward direction 53 than the lock portion 145. The urging force of the pulling spring 114 and the coil spring 78 moves the ink cartridge 30 in the removal direction 52. When the ink cartridge 30 separates from the slider 107, the urging force is no longer applied to the ink cartridge 30, and the ink cartridge 30 stops moving in the removal direction 52. When this occurs, at least the rear cover 31 of the ink cartridge 30 is positioned outside of the case 101, and the user can take the ink cartridge 30 out of the cartridge mounting portion 110.]

[Advantages]

According to the above-described embodiment, because the lower portion 41L of the rear face 41 of the rear cover 31 is positioned further in the insertion direction 51 than the upper portion 41U of the rear face 41 of the rear cover 31 when the ink cartridge 30 is inserted into the cartridge mounting portion 110, a user tends to push the upper portion 41U, which is positioned closer to the user, and tends not to push the lower portion 41L. When the upper portion 41U is pushed, a moment of force is applied to the ink cartridge 30 in the cartridge mounting portion 110, such that the ink cartridge 30 pivots about the pivot center from the second attitude to the first attitude. The lock surface 151 of the ink cartridge 30 in the first attitude contacts the lock portion 145 in the removal direction 52 and the movement of the ink cartridge 30 relative to the cartridge mounting portion 110 in the removal direction 52 is restricted, i.e., the ink cartridge 30 is locked in the cartridge mounting portion 110. A user can readily insert and lock the ink cartridge 30 in the cartridge mounting portion 110.

Because the upper portion 41U of the rear face 41 comprises the letter or symbol indicating that the upper portion 41U is supposed to be pushed, a user is urged to push the upper portion 41U.

Because the condition FH>GL is satisfied, a moment of force generated by the upper portion 41U of the rear face 41 being pushed and causing the ink cartridge 30 to pivot from the second attitude to the first attitude becomes greater than a moment of force generated by the gravitational force acting on the ink cartage 30 and causing the ink cartridge 30 to pivot from the first attitude to the second attitude.

Because the condition (Fcosa)N>GL is satisfied, even if the lower portion 41L of the rear face 41 is pushed, a moment of force generated by the lower portion 41 Lof the rear face 41 being pushed and causing the ink cartridge 30 to pivot from the second attitude to the first attitude becomes greater than the moment of force generated by the gravitational force acting on the ink cartage 30 and causing the ink cartridge 30 to pivot from the first attitude to the second attitude.

Because the second protrusion 86 is positioned further in the downward direction 53 than the ink supply portion 34 when the ink cartridge 30 is in the second position, and the second protrusion 86 receives the urging force from the pulling spring 114 via the slider 107, an additional moment of force is applied to the ink cartridge 30, causing the ink cartridge 30 to pivot from the second attitude to the first attitude.

Because the position of the pivot center O and the positions of the electrodes 65 along the insertion direction 51 at least partly overlap when the ink cartridge 30 is in the second attitude, the magnitude of a moment of force generated by the urging force of the contacts 106 and applied to the ink cartridge 30 is zero or very small.

Because the operation surface 92 is positioned more remote from the pivot center O than the lock surface 151 is, a user can readily operate the operation surface 92 to cause the ink cartridge 30 to pivot from the first attitude to the second attitude.

Because the operation surface 92 faces the upward direction 54 and the removal direction 52 when the ink cartridge 30 is in the first attitude, when a user operates the operation surface 92 to release the ink cartridge 30 from the first attitude, the user's force is directed toward the downward direction 53 and the insertion direction 51. Due to the force directed toward the insertion direction 51, the lock surface 151 separates from the lock portion 145. Due to the force directed toward the downward direction 53, the ink cartridge 30 pivots from the first attitude to the second attitude. Therefore, compared to a situation in which the ink cartridge 30 pivots from the first attitude to the second attitude while the lock surface 151 slides on the lock portion 145, the force needed to be applied to the operation surface 92 to cause the ink cartridge 30 to pivot from the first attitude to the second attitude becomes smaller, and the user can readily release the ink cartridge 30.

Because the upper end of the lock surface 151 is positioned outside of the virtual circle C and the lower end of the lock surface 151 is positioned within the virtual circle C when the ink cartridge 30 is in the first attitude, when the urging force is applied to the ink cartridge 30 in the removal direction 52, the lock portion 145 slides on the lock surface 151 toward the lower end of the lock surface 151.

Because the position of the operation surface 92 along the insertion direction 51 and the position of the sub upper face 91 along the insertion direction 51 at least partly overlap, or the operation surface 92 and the sub upper face 91 at least partly overlap in the downward direction 53, and a space is formed between the operation surface 92 and the sub upper face 91, the operation surface 92 becomes recognizable to a user.

Because at least a portion of the operation surface 92 protrudes further in the upward direction 54 than the lock surface 151, even when the ink cartridge 30 falls with the upper face 39, 141 facing the downward direction 53, the lock surface 151 may be protected by the at least a portion of the operation surface 92 and may not be damaged

Modified Embodiments

In the above-described embodiment, the upper portion 41U and the lower portion 41L of the rear face 41 are continuous. Nevertheless, the upper portion 41U and the lower portion 41L of the rear face 41 may not necessarily be continuous. For instance, in another embodiment, the rear face 41 may comprises a portion extending in the forward direction 57 or the rearward direction 58 between the upper portion 41U and the lower portion 41L. Moreover, each of the upper portion 41U and the lower portion 41L may not necessarily be a plane, i.e., a flat surface, but may be a curved surface or a spherical surface in another embodiment.

In the above-described embodiment, when the ink cartridge 30 is in the second attitude, the upper portion 41U of the rear face 41 is substantially perpendicular to the insertion direction 51. The upper portion 41U may not be perpendicular to the insertion direction 51 in another embodiment. The upper portion 41U and the lower portion 41L may not necessarily recognizable as two different portions, but may be formed as a single plane or a single curved surface in another embodiment.

As described in the above-described embodiment, if the upper portion 41U of the rear face 41 is substantially perpendicular to the insertion direction 51 when the ink cartridge 30 is in the second attitude, the force needed to insert the ink cartridge 30 in the insertion direction 51 against the urging force becomes smaller. Moreover, the volume of the inner space of the rear cover 31 becomes larger, and therefore the volume of the ink chamber 36 becomes larger. If the upper portion 41U and the lower portion 41L are formed as two different portions, it may be expected that a user tends to push the upper portion 41U when the ink cartridge 30 is inserted into the cartridge mounting portion 110.

In the above-described embodiment, the cartridge mounting portion 110 comprises the slider 107 and the pulling spring 114, but the slider 107 and the pulling spring 114 are optional. For instance, in another embodiment, the cartridge mounting portion 110 may not comprise the slider 107 and the pulling spring 114, and only the coil spring 78 of the ink supply portion 34 may apply the urging force to the ink cartridge 30 in the removal direction 52 when the ink cartridge 30 is inserted into the cartridge mounting portion 110.

In the above-described embodiment, ink is an example of liquid. Nevertheless, liquid is not limited to ink. For example, liquid can be pre-treatment liquid which is ejected onto the sheet of paper before ink is ejected in printing. Moreover, liquid can be water to be used for washing the recording head 21.

While the invention has been described in connection with various example structures and illustrative embodiments, it will be understood by those skilled in the art that other variations and modifications of the structures and embodiments described above may be made without departing from the scope of the invention. Other structures and embodiments will be understood by those skilled in the art from a consideration of the specification or practice of the invention disclosed herein. It is intended that the specification and the described examples are merely illustrative and that the scope of the invention is defined by the following claims.

The invention claimed is:

1. A liquid cartridge configured to be inserted into a liquid consuming apparatus in a first direction along a horizontal direction against an urging force directed in a second direction opposite the first direction, and thereby to be mounted to the liquid consuming apparatus, comprising:

a liquid chamber configured to store liquid therein;

a front face facing the first direction when the liquid cartridge is inserted into the liquid consuming apparatus;

a liquid supply portion positioned at the front face and configured to allow insertion of a liquid supply tube of the liquid consuming apparatus thereinto;

a seal member positioned at the liquid supply portion and having a liquid supply opening formed therethrough, wherein the seal member is configured to contact an outer surface of the liquid supply tube while being elastically deformed when the liquid supply tube is inserted through the liquid supply opening;

an upper face facing an upward direction when the liquid cartridge is inserted into the liquid consuming apparatus;

a lock surface positioned at the upper face and configured to contact a lock portion of the liquid consuming apparatus in the second direction; and a rear face facing the second direction when the liquid cartridge is inserted into the liquid consuming apparatus, wherein the liquid cartridge is configured to pivot about a pivot center which is a center of the liquid supply opening, when the liquid cartridge is inserted into the liquid consuming apparatus and the liquid supply tube is inserted through the liquid supply opening, wherein the liquid cartridge is configured to pivot between a first attitude and a second attitude, wherein when the liquid cartridge is in the first attitude, the lock surface contacts the lock portion in the second direction and movement of the liquid cartridge relative to the liquid consuming apparatus in the second direction is restricted, and wherein when the liquid cartridge is in the second attitude, the lock surface is positioned further in a downward direction than the lock portion, and the rear face comprises a first portion and a second portion positioned further in the upward direction than the first portion, wherein the first portion comprises a third portion positioned further in the downward direction than the pivot center, and the first portion is positioned further in the first direction than the second portion, and wherein when the liquid cartridge is in the first attitude, an upper end of the lock surface is positioned outside of a virtual circle and a lower end of the lock surface is positioned within the virtual circle, wherein the virtual circle has a center at the pivot center and intersects the lock portion.

2. The liquid cartridge of claim 1, wherein the second portion comprises a letter or symbol thereon, and the letter or symbol indicates that the second portion is supposed to be pushed.

3. The liquid cartridge of claim 1, wherein the following condition is satisfied:

$$FH>GL,$$

wherein G is a magnitude of a gravitational force acting on the liquid cartridge, F is a magnitude of the urging force urging the liquid cartridge in the second direction when the liquid cartridge is in the first attitude, L is a distance between the center of gravity of the liquid cartridge and the pivot center along the first direction when the liquid cartridge is in the second attitude, and H is a height of a lower end of the second portion from the pivot center along the upward direction perpendicular to the first direction when the liquid cartridge is in the second attitude.

4. The liquid cartridge of claim 3, wherein the first portion is a plane intersecting a first virtual plane at an angle of $\alpha$ degrees when the liquid cartridge is in the second attitude, and the first virtual plane is perpendicular to the first direction, and wherein the following condition is satisfied:

$$(F \cos \alpha)N>GL,$$

wherein N is a length of a perpendicular line extending from the pivot center to a second virtual plane which is perpendicular to the first portion and intersects a lower end of the first portion.

5. The liquid cartridge of claim 1, further comprising a receive portion configured to receive the urging force directed in the second direction, wherein the receive portion is positioned further in the downward direction than the liquid supply portion when the liquid cartridge is in the second attitude.

6. The liquid cartridge of claim 5, wherein the receive portion is configured to receive the urging force from an urging member provided in the liquid consuming apparatus.

7. The liquid cartridge of claim 1, further comprising an electrical interface positioned at the upper face and configured to contact a contact provided in the liquid consuming apparatus when the liquid cartridge is in both the first attitude and the second attitude in the liquid consuming apparatus, wherein when the liquid cartridge is in the second attitude, a position of the pivot center along the first direction and a position of the electrical interface along the first direction at least partly overlap.

8. The liquid cartridge of claim 1, further comprising an operation surface positioned at the upper face and positioned further in the second direction than the lock surface.

9. The liquid cartridge of claim 8, wherein the operation surface faces the upward direction and the second direction.

10. The liquid cartridge of claim 8, wherein the operation surface does not move relative to the liquid chamber.

11. The liquid cartridge of claim 8, wherein the upper face comprises a sub upper face positioned further in the third direction than the operation surface, the operation surface and the sub upper face at least partly overlap in the third direction, and a space is formed between the operation surface and the sub upper face in the third direction.

12. The liquid cartridge of claim 8, the operation surface comprises a plurality of elongated protrusions.

13. The liquid cartridge claim 1, wherein the liquid cartridge is configured to be inserted into a case of the liquid consuming apparatus, and the lock surface is configured to contact the lock portion which does not move relative to the case.

* * * * *